US006856958B2

(12) United States Patent
Kochanski et al.

(10) Patent No.: US 6,856,958 B2
(45) Date of Patent: Feb. 15, 2005

(54) METHODS AND APPARATUS FOR TEXT TO SPEECH PROCESSING USING LANGUAGE INDEPENDENT PROSODY MARKUP

(75) Inventors: Gregory P. Kochanski, Dunellen, NJ (US); Chi-Lin Shih, Berkeley Heights, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 660 days.

(21) Appl. No.: 09/845,561

(22) Filed: Apr. 30, 2001

(65) Prior Publication Data

US 2003/0009338 A1 Jan. 9, 2003

Related U.S. Application Data

(60) Provisional application No. 60/230,204, filed on Sep. 5, 2000, and provisional application No. 60/236,002, filed on Sep. 28, 2000.

(51) Int. Cl.[7] ..... G10L 21/00

(52) U.S. Cl. ..... 704/260; 704/258; 704/270

(58) Field of Search ..... 704/260, 258, 704/270, 275, 278, 207

(56) References Cited

U.S. PATENT DOCUMENTS 5,696,879 A * 12/1997 Cline et al. ..... 704/260
5,790,978 A * 8/1998 Olive et al. ..... 704/207
5,796,916 A * 8/1998 Meredith ..... 704/258
5,850,629 A * 12/1998 Holm et al. ..... 704/260
6,006,187 A * 12/1999 Tanenblatt ..... 704/260
6,035,271 A * 3/2000 Chen ..... 704/207
6,397,183 B1 * 5/2002 Baba et al. ..... 704/260
6,442,524 B1 * 8/2002 Ecker et al. ..... 704/277
6,493,673 B1 * 12/2002 Ladd et al. ..... 704/275
6,499,014 B1 * 12/2002 Chihara ..... 704/260
6,510,413 B1 * 1/2003 Walker ..... 704/258
6,539,359 B1 * 3/2003 Ladd et al. ..... 704/275

* cited by examiner

*Primary Examiner*—Susan McFadden

(57) ABSTRACT

Techniques are described for employing a set of tags to model phenomena which are smooth and subject to constraints. Tags may be used to model, for example, muscular movement producing speech. In one advantageous application, a set of tags defining prosodic characteristics is developed, and selected tags are placed in appropriate locations of a body of text. Each tag defines a constraint on the prosodic characteristics of speech produced by processing the text. Processing of the body of speech and the tags produces a set of equations which are solved to produce a curve defining prosodic characteristics over the scope of a phrase, and a further set of equations which are solved to produce a curve defining prosodic characteristics of individual words within a phrase. The data defined by the curves is used with the text to produce speech having the prosodic characteristics defined by the tags. A set of tags may be produced by reading of a training text by a target speaker to produce a training corpus reflecting the prosodic characteristics of the target speaker, and then analyzing the training corpus to generate tags modeling the prosodic characteristics of the training corpus.

30 Claims, 19 Drawing Sheets

YAN 1

YAN 2

SHOU YIN 1 JI

SHOU YIN 2 JI

SHOU YING3 JI

SHOU YING4 JI

METHODS AND APPARATUS FOR TEXT TO SPEECH PROCESSING USING LANGUAGE INDEPENDENT PROSODY MARKUP

This application claims the benefit of U.S. Provisional Application Ser. No. 60/230,204, filed Sep. 5, 2000 and U.S. Provisional Application Ser. No. 60/236,002, filed Sep. 28, 2000, both of which are incorporated herein by reference in their entirety.

FIELD OF THE INVENTION

The present invention relates generally to improvements in representation and modeling of phenomena which are continuous and subject to physiological constraints. More particularly, the invention relates to the creation and use of a set of tags to define characteristics of signals and the processing of the tags to produce signals having the characteristics defined by the tags.

BACKGROUND OF THE INVENTION

Numerous applications require the modeling of phenomena which are smooth and subject to constraints. A notable example of such an application is a text to speech system. Generation of speech is typically smooth because the muscles used to produce speech have a nonzero mass and therefore cannot be subjected to instantaneous acceleration. Moreover, the particular size, shape, placement and other properties of the muscles producing speech impose constraints on the speech which can be produced. A text to speech system preferably produces speech which changes smoothly and constrains the speech which is produced so that the speech sounds as natural as possible.

A text to speech system receives text inputs, typically words and sentences, and converts these inputs into spoken words and sentences. The text to speech system employs a model of specific speaker's speech to construct an inventory of speech units and models of prosody in response to each pronounceable unit of text. Prosodic characteristics of speech are the rhythmic and intonational characteristics of speech. The system then arranges the speech units into the sequence represented by the text and plays the sequence of speech units. A typical text to speech system performs text analysis to predict phone sequences, duration modeling to predict the length of each phone, intonation modeling to predict pitch contours and signal processing to combine the results of the different analyses and modules in order to create speech sounds.

Many prior art text to speech systems deduce prosodic information from the text from which speech is to be generated. Prosodic information includes speech rhythms, pitches, accents, volume and other characteristics. The text typically includes little information from which prosodic information can be deduced. Therefore, prior art text to speech systems tend to be designed conservatively. A conservatively designed system will produce a neutral prosody if the correct prosody cannot be determined, on the theory that a neutral prosody is superior to an incorrect one. Consequently, the prosody model tends to be designed conservatively as well, and does not have the capability to model prosodic variations found in natural speech. The ability to model variations such as occur in natural speech is essential in order to match any given pitch contours, or to convey a wide range of effects such as personal speaking styles and emotions. The lack of such variations in speech produced by prior art text to speech systems contributes strongly to an artificial sound produced by many such systems.

In many applications, it is desirable to use text to speech systems which can carry on a dialog. For example, a text to speech system may be used to produce speech for a telephone menu system which provides spoken responses to customer inputs. Such a system may suitably include state information corresponding to concepts, goals and intentions. For example, if a system produces a set of words which represents a single proper noun, such as "Wells Fargo Bank," the generated speech should include sound characteristics conveying that the set of words is a single noun. In other cases, the impression may need to be conveyed that a word is particularly important, or that a word needs confirmation. In order to convey correct impressions, the generated speech must have appropriate prosodic characteristics. Prosodic characteristics which may advantageously be defined for the generated speech include pitch, amplitude, and any other characteristics needed to give the speech a natural sound and convey the desired impressions.

There exists, therefore, a need for a system of tags which can define phenomena, such as the prosodic characteristics of speech, in sufficient detail to model the phenomena such that they speech have the desired characteristics, and a system for processing tags in order to produce phenomena having the characteristics defined by the tags.

SUMMARY OF THE INVENTION

The current invention recognizes the need for a system which produces phenomena having desired characteristics. To this end, the system includes the generation and processing of a set of tags which can be used to model phenomena which are continuous and subject to physiological constraints. An example of such phenomena are muscle movements. Another example of such phenomena are the prosodic characteristics of speech. Speech characteristics are produced by and dependent on muscle movements and a set of tags can be developed to represent prosodic characteristics of the speech of a particular speaker, or of other desired prosodic characteristics. These tags may be applied to text at suitable locations within the text and may define prosodic characteristics of speech to be generated by processing the text. The set of tags defines prosodic characteristics in sufficient detail that processing of the tags along with the text can accurately model speech having the prosodic characteristics of the original speech from which the tags were developed. Including this level of detail allows the tags to be language independent, because the tags can be used to provide information which would otherwise be provided by knowledge of the prosodic characteristics of the language being used. In this way, a text to speech system employing a set of tags according to the present invention can generate correct prosody in all languages and can generate correct prosody for text that mixes languages. For example, a text to speech system employing the teachings of the present invention can correctly process a block of English text which includes a French quotation, and can generate speech having correct prosodic characteristics for the English portion of the speech as well as correct prosodic characteristics for the French portion of the speech.

In order to provide an accurate representation of speech, the tags preferably include information which defines compromise between tags, and processing the tags produces compromises based on information within the tags and default information defining how tags are to relate to one another. Many speech units influence the characteristics of other speech units. Adjacent units have a particular tendency to influence one another. If tags used to define adjacent units, such as syllables, words or word groups, contain conflicting instructions for assignment of prosodic characteristics, information on priorities and how conflicts and compromises are to be treated allows proper adjustments to be made. For example, each of the adjacent words or phrases may be adjusted. Alternatively, if the tag information indicates that one of the adjacent words or phrases is to predominate, appropriate adjustments will be made to the other word or phrase.

A tag set can be defined by training, that is, by analyzing the characteristics of a corpus of training text as read by a particular speaker. Tags can be defined using the identified characteristics. For example, if the training corpus reveals that a speaker has a base speaking frequency of 150 Hz and the pitch of his or her speech rises by 50 Hz at the end of a question sentence, a tag can be defined to set the base frequency of generated speech to 150 Hz and to set the rise in pitch at the end of questions to 50 Hz.

Once tags have been established, they can be entered into a body of text from which it is desired to generate speech. This can be done by simply entering appropriate tags into the text using an editor. For example, if it is desired to perform text to speech processing on the sentence "You are the weakest link," and to establish a base frequency of 150 Hz with an accent on the word "are", tags can be added to the sentence as follows: <setbase=150/> You <stress strength=4 type=0.5 pos=* shape=−0.2s0.03, −0.1s0.03, 0s0, 0.1s−0.1, 0.2s−0.1/> are <slope=−0.8/> the weakest link.

This will result in a phrase curve having a pitch centered around 150 Hz, with an accent on the word "are" and with a decline in pitch from the end of the word "are" to the end of the sentence. When the data defined by the text and the tags is provided to a speech generation device, for example an articulator, the enunciation of the sentence by the speech generation device will reflect the characteristics defined by the phrase curve. Further aspects of tags and their effects are discussed in detail below.

As an alternative to entering tags using an editor, it is possible to place tags in speech automatically according to a programmed set of rules. An exemplary set of rules to define the pitch of a declarative sentence may be, for example, set a declining slope over the course of the sentence and use a falling accent for the last word in the sentence. Applying these rules to a body of text will establish appropriate tags for each declarative sentence in the body of text. Additional rules may be employed to define other sentences types and functions. Other tags may be established and applied to the text in order to define, for example, volume (amplitude) and accent (stress).

Once a body of text has been developed with a set of tags, the tags are processed. First, phrase curves are calculated. A phrase curve is a curve representing a prosodic characteristic, such as pitch, calculated over the scope of a phrase. In processing text using accompanying tags according to the present invention, phrase curves may suitably be developed by processing one minor phrase at a time, where a minor phrase is a phrase or subordinate or coordinate clause. A sentence typically comprises one or more minor phrases. Boundaries are imposed in order to restrict the ability of tags in a minor phrase to influence preceding minor phrases. Next, prosody is calculated relative to the phrase curves. Prosodic characteristics on the scale of individual words are calculated, and their effect on each phrase is computed. This calculation models the effects of accented words, for example, appearing within a phrase. After prosody has been calculated relative to the phrase curves, a mapping from linguistic attributes to observable acoustical characteristics is then performed. The acoustical characteristics are then applied to the speech generated by processing the text. The acoustical characteristics may suitably be represented as a curve or set of curves each of which represents a function of time, with the curve having particular values at a particular time. Because the speech is generated by a machine, the time of occurrence of each speech component is known. Therefore, prosodic characteristics appropriate to a particular speech component can be expressed as values at a time the speech component is known to occur. The speech components can be provided as inputs to a speech generation device, with values of the observable prosodic characteristics also provided to the speech generation device to control the characteristics of the speech.

A more complete understanding of the present invention, as well as further features and advantages of the invention, will be apparent from the following Detailed Description and the accompanying drawings.

DETAILED DESCRIPTION

The following discussion describes techniques for specifying phenomena which are smooth and subject to constraints according to the present invention. Such phenomena include but are not limited to muscle dynamics. The discussion and examples below are directed primarily to specifying and producing prosodic characteristics of speech. Speech is a well known example of a phenomenon produced by muscle dynamics, and the modeling and simulation of speech is widely practiced and significantly benefits from the advances and improvements taught by the present invention. The muscular motions which produce speech are smooth because the muscles have nonzero mass and therefore are unable to accelerate instantaneously. Moreover, the muscular motions which produce speech are subject to constraints due to the size, strength, location and similar characteristics of the muscles producing speech. The present invention is not limited to the specification and modeling of speech, however, and it will be recognized that the techniques described below are not limited to speech, but may be adapted to specification of other phenomena controlled by muscle dynamics, such as the modeling of muscular motion, including but not limited to gestures and facial expression, as well as other phenomena which are characterized by smooth changes which are subject to constraints.

In the discussion below, an overall process for employment of the present invention for text to speech processing is described. Next, a set of tags used for specifying prosodic characteristics is described. The general structure and grammar of tags is described, followed by a description of each category of tags and parameters and values used in the tags. Next, the effects of each of a number of exemplary tags are discussed, showing the effects of different parameters, compromise between conflicting tags, and other representative properties of tags. There then follows a description of the processing of a body of text including tags according to the present invention, a method of developing and using tags to produce speech having the prosodic characteristics of a target speaker, and a text to speech processing system according to the present invention. Finally, a process for modeling motion phenomena is described.

Figure 1:
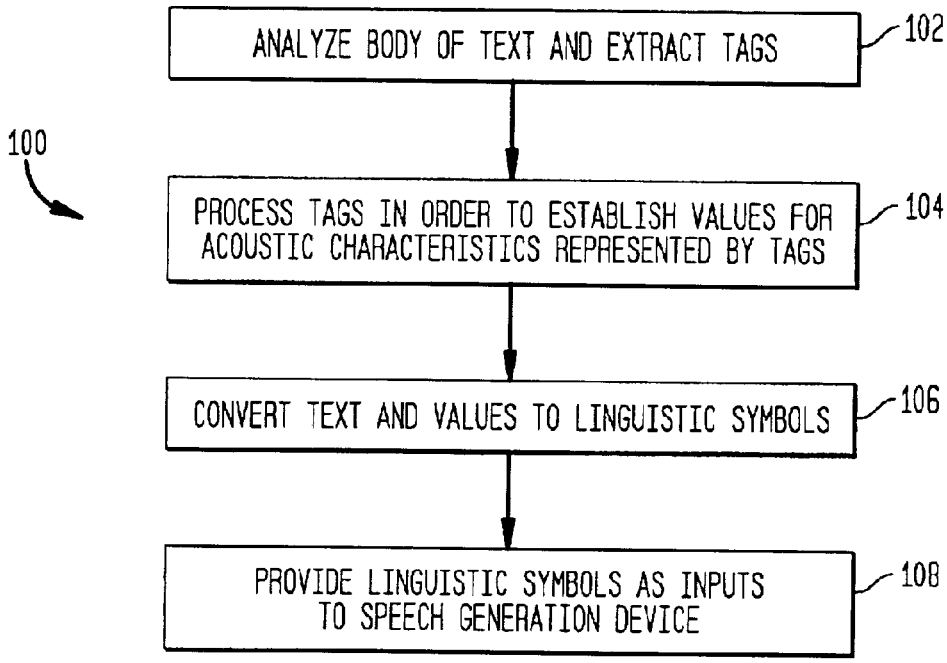
FIG. 1 illustrates a process of text to speech processing according to the present invention.

FIG. 1 illustrates a process 100 of text to speech processing of a body of text including tags according to the present invention. At step 102, the body of text is analyzed and the tags are extracted. At step 104, the tags are processed in order to determine values for acoustic characteristics defined by the tags, such as pitch and volume as a function of time. At step 106, the text and the values which have been determined for the acoustic characteristics are converted to linguistic symbols to be furnished to a speech generation device. At step 108, the linguistic symbols are provided as inputs to a speech generation device in order to produce speech having the prosodic characteristics defined by the tags. The speech generation device may suitably be an articulator which produces speech through a series of motions, with the tags controlling prosodic characteristics of the speech produced by controlling aspects of the motions of the articulator.

Tags are placed within a body of text, typically between words, in order to define the prosodic characteristics desired for the speech generated by processing the text. Each tag imposes a set of constraints on the prosody. <Step> and <stress> tags include "strength" parameters, which define their relationship to other tags. Tags frequently contain conflicting information and the "strength" parameters determine how conflicts are resolved. Further details of "strength" parameters and their operation are discussed below.

Tags may suitably be defined in XML, or Extensible Markup Language format. XML is the universal format for structured documents on the World Wide Web, and is described at www.w3.org/XML. It will be clear to those skilled in the art that tags need not be realized in XML syntax. Tags may be delimited by any arbitrary character sequences, as opposed to "<" and ">" used in XML), and the internal structure of the tags may not follow the format of XML but may suitably be any structure that allows the tag to be identified and allows the necessary attributes to be set. It will also be recognized that tags need not be interleaved with the text in a single stream of characters. Tags and text may, for instance, flow in two parallel data channels, so long as there is a means of synchronizing tags with the locations in the text sequence to which they correspond.

Tags may also be used in cases in which no text exists and the input consists solely of a sequence of tags. Such input would be appropriate, for example, if these tags were used to model muscle dynamics for a computer graphics application. To take an example, the tags might be used to control fin motions in a simulated goldfish. In such a case, it would be unnecessary to separate the tags from the nonexistent text, and tag delimiters would be required only to separate one tag from the next.

Finally, it will be recognized that the tags need not be represented as a serial data stream, but can instead be represented as data structures in a computer's memory. In a dialogue system, for example, in which a computer program is producing the text and tags, it may be most efficient to pass a pointer or reference to a data structure that describes text (if any), tags, and temporal relations between text and tags. The data structures that describe the tags would then contain information equivalent to the XML description, possibly along with other information used, for example, for debugging, memory management, or other auxiliary purposes.

A set of tags according to the present invention is described below. In this description, literal strings are enclosed in quotation marks. As is standard in XML notation, "?" marks optional tokens, "*" marks zero or more occurrences of a token and "+" marks one or more occurrences of the token. Tag grammar is expressed in the format Tag="<" tagname AttValue* "/>", where "AttValue" is a normal XML list of a tag's attributes.

An exemplary tag is

<set base="200"/>. This tag sets the speaker's base frequency to 200 Hz. In this example, "<" indicates the beginning of the tag, "set" is the action to be taken, that is, to set a value of a specified attribute, "base" is the attribute for which a value is to be set, "200" is the value to which the attribute "base" is to be set, and "/>" indicates the end of the tag.

Each tag comprises two parts. The first part is an action and the second part is a set of attribute-value pairs that control the details of the tag's operation. Most of the tags are "point" tags, which are self-closing. In order to allow for precision in defining when a tag is to operate, a tag may include a "move" attribute. This attribute allows tags to be placed at the beginning of a word, but to defer their action to somewhere inside the word. The use and operation of the "move" attribute will be discussed in further detail below.

Tags fall into one of four categories: (1) tags which set parameters; (2) tags which define a phrase curve or points from which a phrase curve is to be constructed; (3) tags which define word accents; and (4) tags which mark boundaries.

Parameters are set by the <set> tag, which has the grammar <set Att=value>, where "Att" is the attribute which the tag controls, and value is a numerical value for the attribute. The <set> tag accepts the following attributes:

max=value. This attribute sets maximum value which is to be allowed, for example the maximum frequency in Hertz which is to be produced in cases in which pitch is the property being controlled.

min=value. This attribute sets the minimum value which is to be allowed, for example frequency in Hertz which is to be produced in cases in which pitch is the property being controlled.

smooth=value. This controls the response time of the mechanical system being simulated. In cases in which pitch is being controlled, this parameter sets the smoothing time of the pitch curve, in seconds, in order to set the width of a pitch step.

base=value. This sets the speaker's baseline, or frequency in the absence of any tags.

range=mvalue. This sets the speaker's pitch range in Hz.

pdroop=value. This sets the phrase curve's droop toward the base frequency, expressed in units of fractional droop per second.

adroop=value. This sets the pitch trajectory's droop rate toward the phrase curve, expressed in units of fractional droop per second.

add=value. This sets the nonlinearity in the mapping between the pitch trajectory over the scope of a phrase and the pitch trajectory of individual words having local influences on the phrase. If the value of "add" is equal to 1, a linear mapping is performed, that is, an accent will have the same effect on pitch whether it is riding on a high pitch region or a low pitch region. If the value of "add" is equal to 0, the effect of an accent will be logarithmic, and small accents will make a larger change to the frequency when riding on a high phrase curve. If the value of "add" is greater than 1, a slower than linear mapping will be performed.

jitter=value. This sets the root mean squared (RMS) magnitude of the pitch jitter, in units of fractions of the speaker's range. Jitter is the extent of random pitch variation introduced to give processed speech a more natural sound.

jittercut=value. This sets the time scale of the pitch jitter, in units of seconds. The pitch jitter is correlated (1/f) noise on intervals smaller than jittercut, and is uncorrelated, or white, noise on intervals longer than "jittercut." Large values of "jittercut" define longer, smoother values in pitch while small values of "jittercut" define short, choppy pitch changes.

Arguments provided to the <set> tag are retained for each voice until text to speech processing is completed, even across phrase boundaries.

The <step> tag takes several arguments, and operates on the phrase curve. The <step> tag takes the form <step by=value|to=value|strength=value>. The attributes of the <step> tag are as follows:

by=value. This defines the size of each step as a fraction of the speaker's range. The step in the phrase curve is smoothed by the "smooth" time. The parameter "smooth" is defined above.

to=value. This is the frequency to which the steps are proceeding, expressed as a fraction of the speaker's range.

strength=value. This attribute controls how a particular <step> tag interacts with its neighbors. If the value of "strength" is high, the tag dominates its neighbors, while if the value of "strength" is low, the tag is dominated by its neighbors.

The <slope> tag takes one argument and operates on the phrase curve. The <slope> tag has the form <slope rate= value "%"?>. This sets a rate of increase or decrease for the phrase, expressed as a fraction of the range of the speaker per second. If the "%" symbol is present, the value expresses the increase or decrease in terms of the fraction of range per unit length of the minor phrase.

The <stress> tag defines the prosody relative to the phrase curve. Each <stress> tag defines a preferred shape and a preferred height relative to the phrase curve. <stress> tags, however, often define conflicting properties. Upon processing of a <stress> tag, the preferred shape and height defined by the <stress> tags will be modified in order to permit these properties to compromise with one another, and with the requirement that the pitch curve must be smooth. The <stress> tag has the form <stress shape=(point ",")* point|strength=value|type=value>.

The "shape" parameter specifies, in terms of a set of points, the ideal shape of the accent curve in the absence of compromises with other stress tags or constraints.

The "strength" parameter defines the linguistic strength of the accent. Accents with zero strength have no effect on pitch. Accents with strengths much greater than 1 will be followed accurately, unless they have neighbors having comparable or greater strengths, in which case the accents will compromise with or be dominated by their neighbors, depending on the strengths of the neighbors. Accents with strengths approximately equal to 1 will result in a pitch curve which is a smoothed version of the accent.

The "type" parameter controls whether the accent is defined by its mean value relative to the pitch curve or by its shape. The value of the "type" parameter comes into play when it is necessary for an accent to compromise with neighbors. If the accent is much stronger than its neighbors, both shape and mean value of pitch will be preserved.

However, in cases where compromise is necessary, "type" determines which property will be compromised. If "type" has a value of 0, the accent will keep its shape at the expense of average pitch. If "type" has a value of 1, the accent will maintain its average pitch at the expense of shape. For values of "type" between 0 and 1, a compromise between shape and average pitch will be struck, with the extent of the compromise determined by the actual value of "type."

The "point" parameter in the "shape" argument of the <stress> tag follows the syntax:

point=float (*X"s"|X"p"|X"y"|X"w"*) value. A point on the accent curve is specified as a (time, frequency) pair where frequency is expressed as a fraction of the speaker's range. X is measured in seconds, (s), phonemes (p), syllables (y) or words (w). The accent curves are preferably constrained to be smooth, and it is therefore not necessary to specify them with great particularity.

Figure 2:
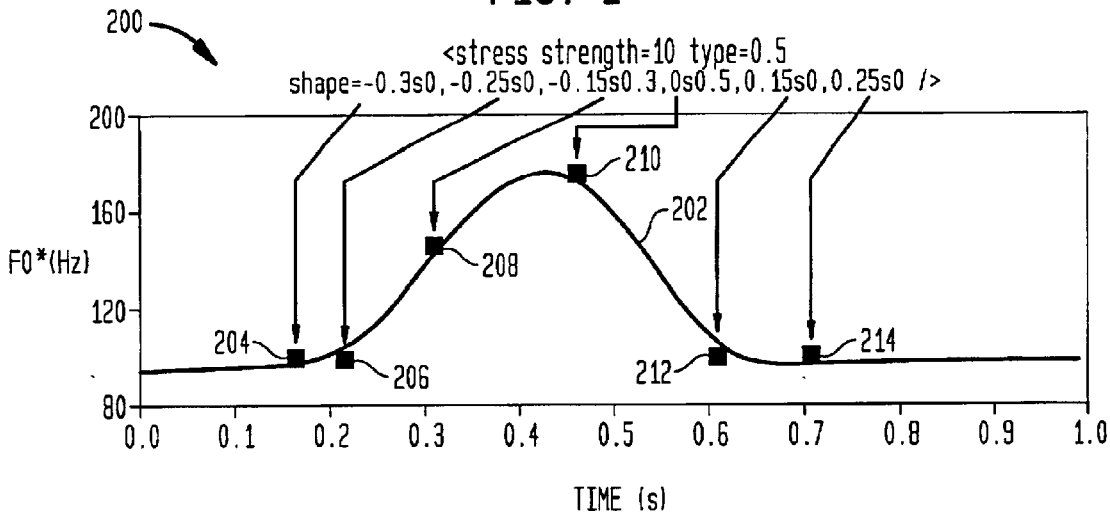
FIG. 2 illustrates an accent curve generated by processing of tags according to the present invention.

FIG. 2 is a graph 200 illustrating an exemplary accent curve 202 described by a stress tag having the value <stress strength=10 type=0.5 shape=0.3s0,0.15s0.3,0s0.5,0.15s0, 0.25s0/>. Processing of the tag produces the points 204–214, and the curve 202 which fits the points 204–214. Fitting of the curve 202 to the points 204–214 is preferably designed to produce a smooth curve, reflecting a natural sound typical of human speech.

In addition to the tags previously discussed, a <phrase> tag is implemented which inserts a phrase boundary. Normally, the <phrase> tag is used to mark a minor phrase or breath group. No preplanning occurs across a phrase tag. The prosody defined before a <phrase> tag is entirely independent of any tags occurring after the <phrase> tag.

As noted above, any tag may include a "move" attribute, directing the tag to defer its action until the point specified by the "move" attribute. The "move" attribute conforms to the following syntax:

AttValue=position|other_attributes, where position="move" "=" move_value,
the more_value=("e"|"1") ? motion*, and
motion=(float|"b"|"c"|"e") ("r"|"w"|"y"|"p"|"s") "*"|"?"

Motions are evaluated in a left to right order. The position is modeled as a cursor that starts at the tag, unless the more_value starts with "e|1". In that case, the last cursor position from the previous tag is used as the starting point. Normally, tags will be placed within words and the "move" attribute will be used to position accents inside a word. Motions can be specified in terms of minor phrases (r), words (w), syllables (y), phonemes (p) or accents (*). Specifying motions in terms of minor phrases and words are useful if the tags are congregated at the beginning of phrases. Rules for identifying motions are as follows. Motions specified in terms of minor phrases skip over any pauses between phrases. Motions specified in terms of words skip over any pauses between words. Moves specified in terms of syllables treat a pause as one syllable. Motions specified in terms of phonemes treat a pause as one phoneme. Using a "b", "c" or "e" as a motion moves the pointer to the nearest beginning, center, or end respectively, of a phrase, word, syllable or phoneme. Moves specified in terms of seconds move the pointer that number of seconds. The motion "*" (stressed) moves the pointer to the center of the next stressed syllable.

An example of a tag including a "move" command is as follows:

<step move=*0.5*p* by=1/>

The effect of this tag to put a step in the pitch curve, with the steepest part of the step 0.5 phoneme after the center of the first stressed syllable after the tag. Because of the "move" attribute, the tag is effective at the desired point, rather than at the location of the tag itself.

Figure 3A:
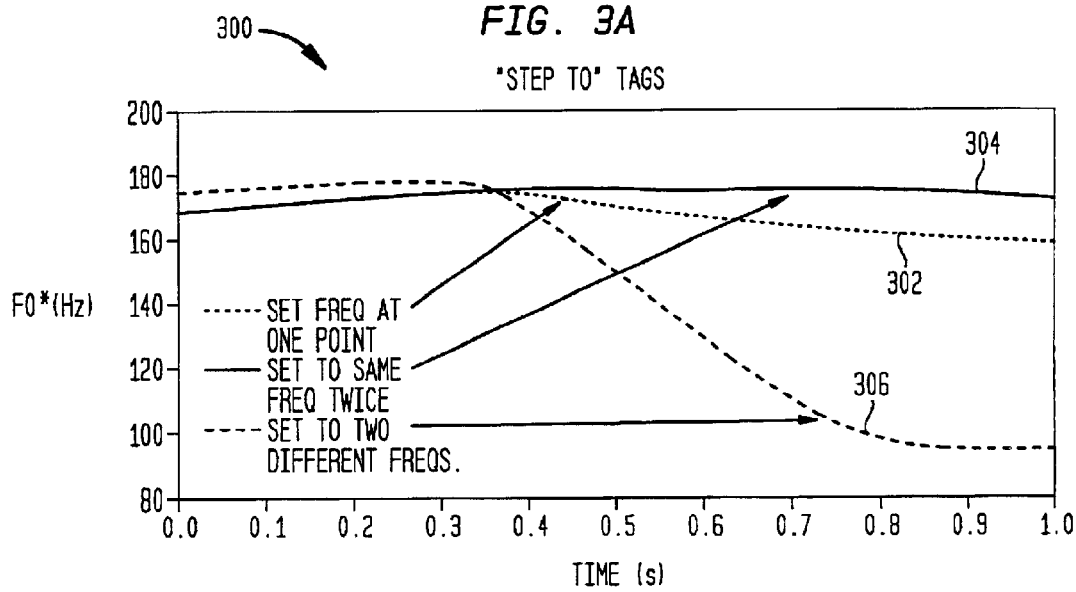
FIGS. 3A and 3B are graphs illustrating the effect of <step> tags according to the present invention.

FIGS. 3A–3I illustrate the effects of various tags. FIG. 3A is a graph 300 illustrating curves 302–306 resulting from processing of a <step to> tag setting a single frequency, two <step to> tags each setting the same frequency and two <step to> tags each setting different frequencies, respectively. The curve 302 results from the tag <step strength=10 to=0.5/>. The curve 304 results from a first tag <step strength=10 to=0.5/>, followed by intervening text, followed in turn by a second tag <step strength=10 to=0.5/>. The curve 306 results from a first tag <step strength=10 to=0.5/>, followed by intervening text, followed in turn by a second tag <step strength=10 to=0/>.

The <step by> tag simply inserts a step into the pitch curve. The tag <step by=X/> directs the pitch after the tag to be X Hz higher than the pitch after the tag. The tag changes the pitch, but does not force the pitch on either side of the tag to take any particular value. The <step by> tag therefore does not tend to conflict with other tags. For example, if a <step to=100/> tag is followed by a <step by=−50/>, the frequency preceding the <step by=−50/> tag will be 100 Hz and the frequency following the tag will be 50 Hz.

Figure 3B:
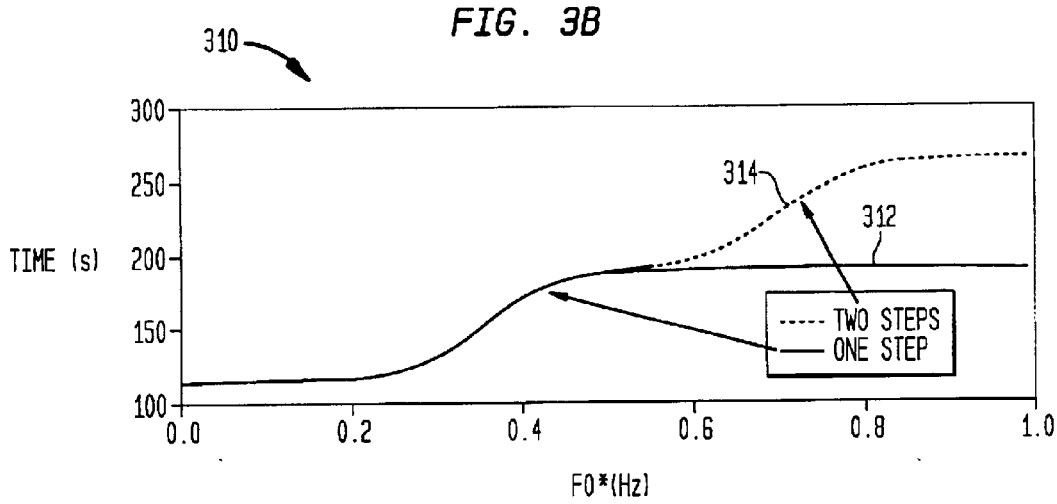

FIG. 3B is a graph 310 illustrating the curves 312 and 314. The curve 312 results from the sequence of tags <step to=0.1 strength=10/> . . . <step by=0.3 strength=10/>. The curve 314 results from the sequence of tags <step to=0.1 strength=10/> . . . <step by=0.3 strength=10/> . . . <step by=0.3 strength=10/>. No compromising is necessary in this example, because none of the constraints on the pitch curve conflict.

Also relevant for phrase curves is the <slope> tag. Depending on its argument, the <slope> tag causes the phrase curve to slope up or down to the left of the tag, that is, previous in time to the tag. Slope tags cause replacement of the current slope value. By way of illustration, the sequence of tags <slope rate=1/> . . . <slope rate=0/> results in a slope of zero. The tag <slope rate=0/> replaces the slope set by the tag <slope rate=1/> and any previous tags.

Figure 3C:
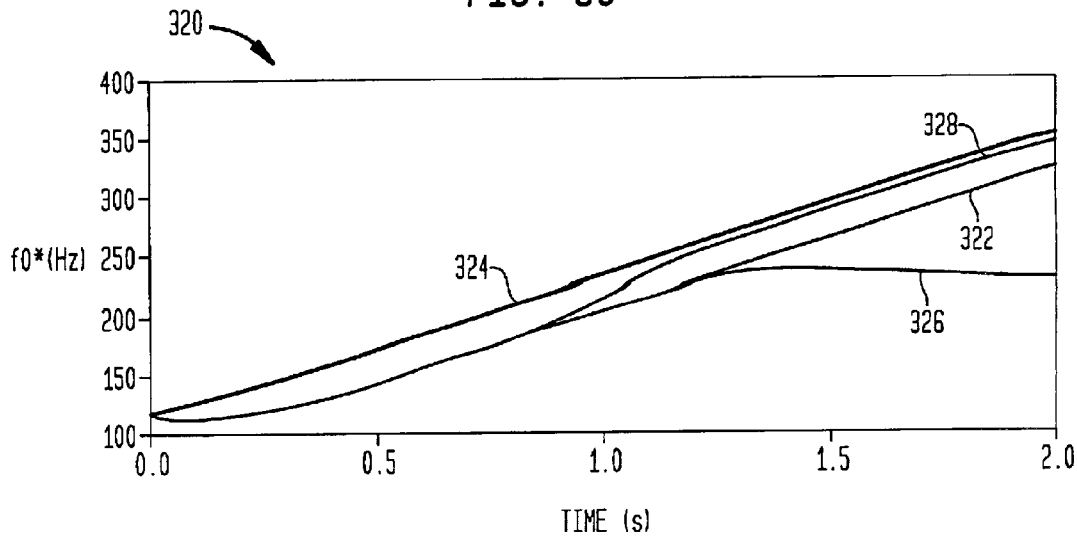
FIG. 3C is a graph illustrating the effect of a <slope> tag according to the present invention.

FIG. 3C is a graph 320 including curves 322–328. The curve 322 results from the tag <slope rate=0.8/>. The curve 324 results from the sequence of tags <slope rate=0.8/> . . . <step by=0.1 strength=10>. The curve 326 results from the tag . . . <slope rate=0.8>. The curve 328 results from the sequence of tags <slope rate=0.8/> . . . <set slope=0.1/>. The curves 322–328 represent, respectively, a slope beginning at a phrase boundary, a slope delayed by 0.25 second, a slope with a small step superposed and a slope up followed by a slope down. No compromising is necessary, because a <slope> tag having a new value replaces any value imposed by a previous <slope> tag.

Figure 3D:
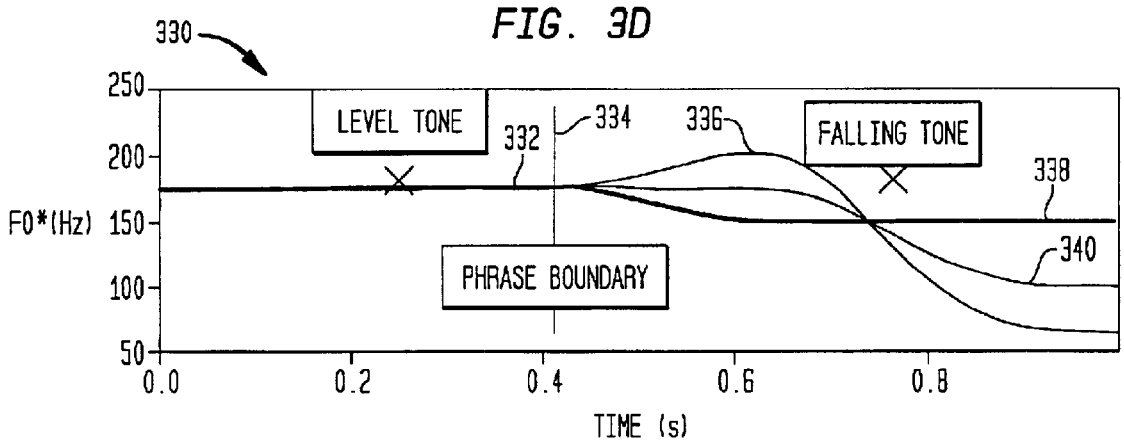
FIG. 3D is a graph illustrating the effect of a <phrase> tag according to the present invention.

FIG. 3D illustrates the effect of <phrase> tags. A graph 330 shows a curve 332 illustrating a level tone. The curve 332 is followed by a phrase boundary 334. Following the phrase boundary are curves 336–339, illustrating a tone of varying amplitude. The graph 330 illustrates the effect of the tag series <stress strength=4 type=0.8 shape=−0.1s0.3, 0.1s0.3/> . . . <phrase/> . . . <stress strength=4 type=0.1 shape=various/>. The <phrase> tag prevents the falling tone following 0.42 seconds from having any effect on the level tone which precedes 0.42 seconds.

<Phrase> tags mark boundaries where preplanning stops and are preferably placed at minor phrase boundaries. A minor phrase is typically a phrase or a subordinate or coordinate conduction smaller in scope than a full sentence. Typical human speech is characterized by planning of or preparation for prosody, this planning or preparation occurring a few syllables before production. For example, preparation allows a speaker to smoothly compromise between difficult tone combinations or to avoid running above or below a comfortable pitch range. The system of placement and processing of tags according to the present invention is capable of modeling this aspect of human speech production, and the use of the <phrase> tag provides for control of the scope of preparation. That is, placement of the <phrase> tag controls the number of syllables over which compromise or other preparation will occur. The phrase tag acts as a one-way limiting element, allowing tags occurring before the <phrase> tag to affect the future, but preventing tags occurring after the <phrase> tag from affecting the past.

FIGS. 3E–3I illustrate the effects of <stress> tags. <Stress> tags allow accenting of words or syllables. A stress tag always includes at least the following three elements. The first element is the ideal "Platonic" shape of the accent, which is typically close to the shape the accent would have in the absence of neighbors and if spoken very slowly. The second element is the accent type. The third element is the strength of the accent. Strong accents tend to keep their shape, while weak accents tend to be dominated by their neighbors.

Figure 3E:
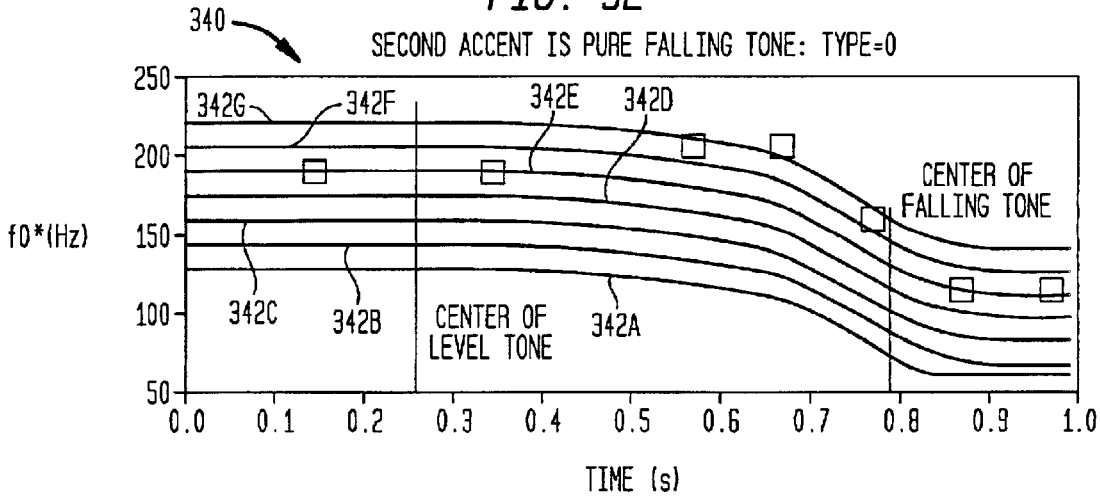
FIGS. 3E–3I illustrate the effects and interrelationships of <stress> tags according to the present invention.

The act of speaking creates a compromise between these tendencies, and any system which seeks to model speech under these circumstances must also have a way of compromising between such tendencies. The "strength" argument of the <stress> tag controls interaction between tags which express conflicting requirements. FIG. 3E is a graph 340 illustrating the interaction between a level tone of type 0.8 preceding a pure falling tone of type 0. Because the level tone is of type 0.8, that is, the type value is close to 1, it tends to maintain its average pitch at the expense of shape. The falling tone is of type 0, and therefore maintains its shape at the expense of its average pitch. The curves 342A–342G illustrate the effects of the tag sequence <stress strength=4 type=0.8 shape=–0.1sY, 0.1sY/> . . . <stress strength=4 type=0 shape=–0.2.03, –0.1s0.03, 0s0, 0.1s–0.1, 0.2s–0.1/>, where the value of Y varies from –0.1 to 0.5 in increments of 0.1.

Figure 3F:
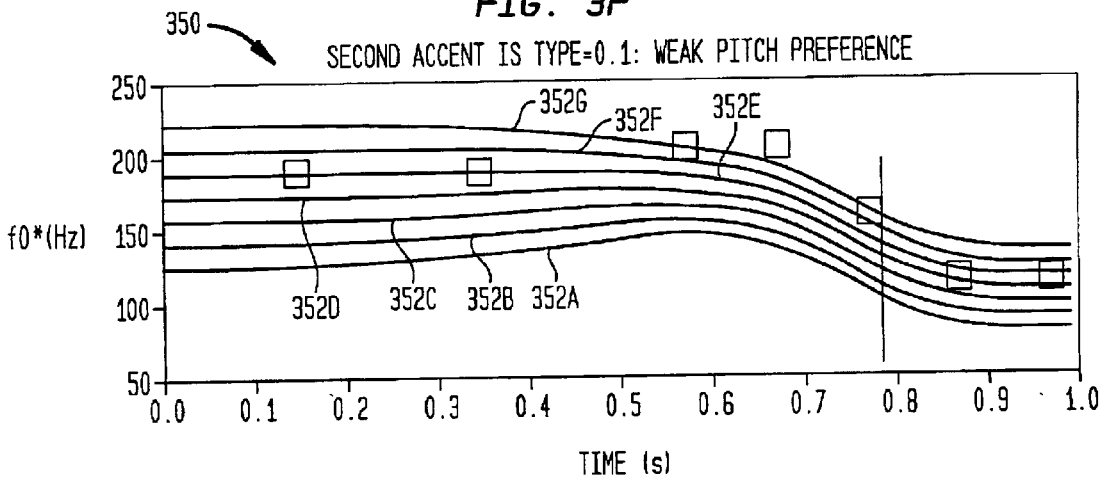

FIG. 3F is a graph 350 illustrating the interaction between a level tone of type 0.8 preceding a falling tone of type 0.1. Because the level tone is of type 0.8, that is, the type value is close to 1, it tends to maintain its average pitch at the expense of shape. The falling tone is of type 0.1, and therefore manifests a slight tendency to compromise its shape in order to maintain its pitch. The curves 352A–352G illustrate the effects of the tag sequence <stress strength=4 type=–0.8 shape=–0.1sY, 0.1sY/> . . . <stress strength=4 type=0.1 shape=–0.2.03, –0.1s0.03, 0s0, 0.1s–0.1, 0.2s–0.1/>, where the value of Y varies from –0.1 to 0.5 in increments of 0.1. It can be seen that the curves 352A–352G are converging slightly in the area of the falling tone, because of the slight pitch preference exhibited by the tone.

Figure 3G:
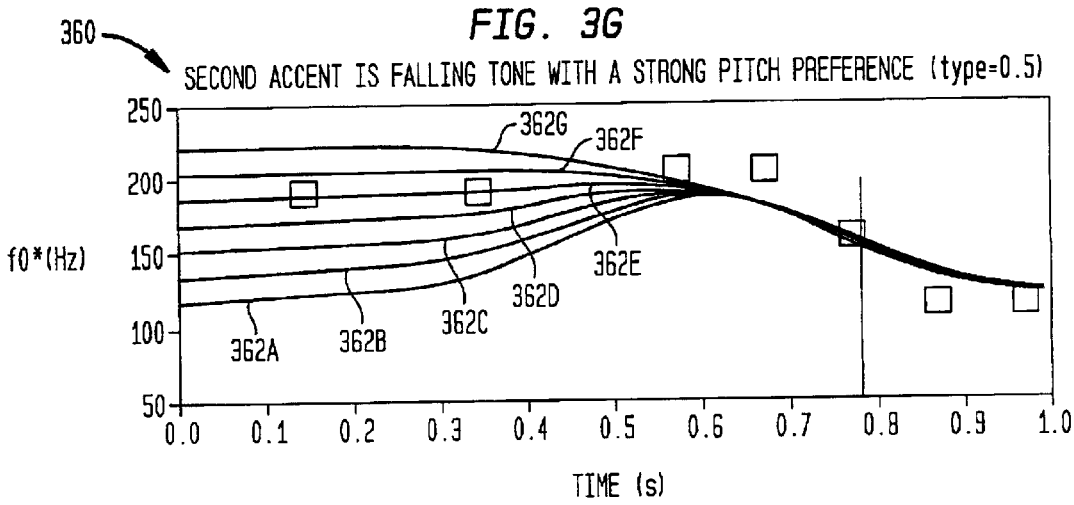

FIG. 3G is a graph 360 illustrating the interaction between a level tone of type 0.8 preceding a falling tone of type 0.5. Because the level tone is of type 0.8, that is, the type value is close to 1, it tends to maintain its average pitch at the expense of shape. The falling tone is now of type 0.5, and therefore shows a strong tendency to maintain its pitch, leading to a compromise between pitch and shape. The curves 362A–362G illustrate the effects of the tag sequence <stress strength=4 type=0.8 shape=–0.1sY, 0.1sY/> . . . <stress strength=4 type=0.5 shape=–0.2.03, –0.1s0.03, 0s0, 0.1s–0.1, 0.2s–0.1/>, where the value of Y varies from –0.1 to 0.5 in increments of 0.1. It can be seen that the curves 362A–362G are still maintaining their shape, but are strongly compressed together in order to maintain pitch.

Figure 3H:
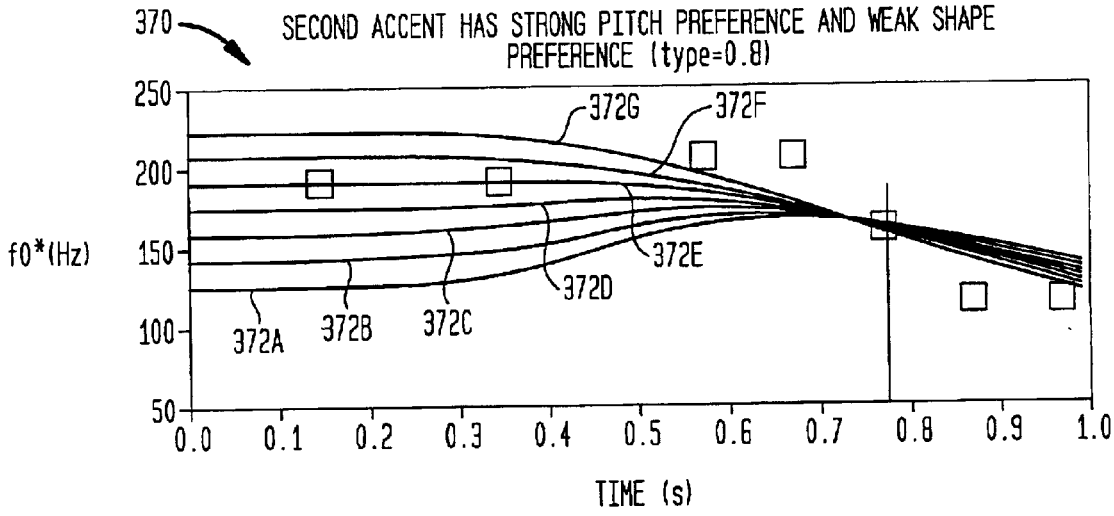

FIG. 3H is a graph 370 illustrating the interaction between a level tone of type 0.8 preceding a falling tone of type 0.8. Because the level tone is of type 0.8, that is, the type value is close to 1, it tends to maintain its average pitch at the expense of shape. The falling tone is now of type 0.8, and therefore shows a very strong tendency to maintain its pitch and only a weak tendency to maintain its shape. The curves 372A–372G illustrate the effects of the tag sequence <stress strength=4 type=0.8 shape=–0.1sY, 0.1sY/> . . . <stress strength=4 type=0.8 shape=–0.2.03, –0.1s0.03, 0s0, 0.1s–0.1, 0.2s–0.1/>, where the value of Y varies from –0.1 to 0.5 in increments of 0.1. It can be seen that the curves 372A–372G have a greatly reduced tendency to maintain their shape, although the shape preference is able to force the pitch to decline near its midpoint. When the first tone, that is, the level tone, has a low pitch, the pitch curve now has a strong tendency to rise between the two tones in order to maintain the correct pitch at the center of the second accent.

Figure 3I:
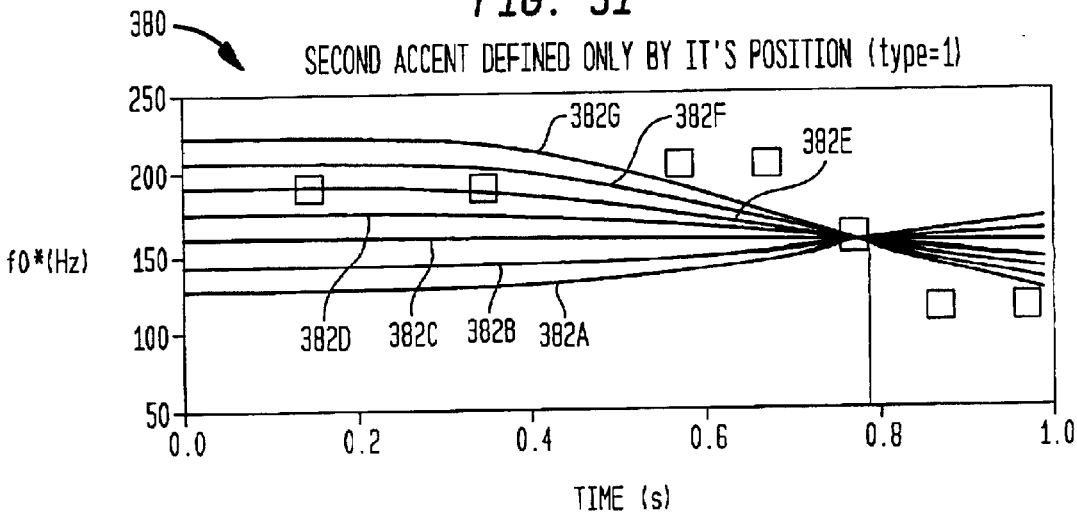

FIG. 3I is a graph 380 illustrating the interaction between a level tone of type 0.8 preceding a falling tone of type 0.8. Because the level tone is of type 0.8, that is, the type value is close to 1, it tends to maintain its average pitch at the expense of shape. The falling tone is now of type 1, and therefore maintains pitch, compromising shape as necessary in order to maintain pitch exactly. The curves 382A–382G illustrate the effects of the tag sequence <stress strength=4 type=0.8 shape=–0.1sY,0.1sY/> . . . <stress strength=4 type=1 shape=–0.2.03, –0.1s0.03, 0s0, 0.1s–0.1, 0.2s–0.1/>, where the value of Y varies from –0.1 to 0.5 in increments of 0.1. It can be seen from the curves 382A–382G that the falling tone is now defined entirely by its pitch.

Another example of compromise between tags can be seen when accents are brought close together. The result of two overlapping accents is less than the sum of both accents. Instead, a single accent is formed of the same size and shape, but having twice the strength of either accent individually.

Figure 4:
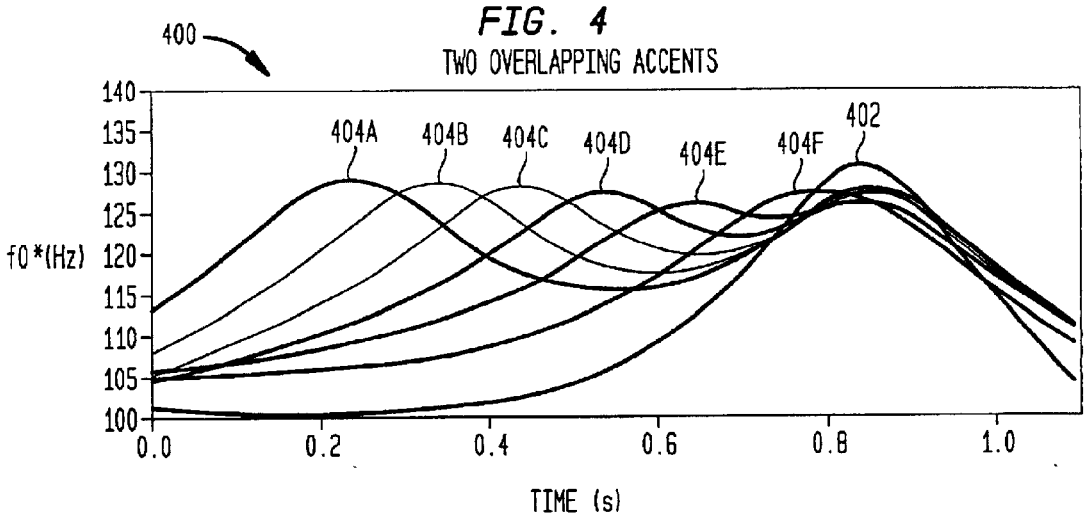
FIG. 4 is a graph illustrating compromise between tags according to the present invention.

FIG. 4 is a graph 400 illustrating the result of a stationary accent curve 402 peaking at 0.83s, and accent curves 404A–404E as they move progressively toward the curve 402 until the curve 404F overlaps with the curve 402. The curves 404A–404E are successively displaced upwards in the plot for clarity and ease of viewing. The curves 402 and 404A–404E are the result of processing the tag sequence <stress strength=4 shape=–0.15s0, –0.1s0, –0.05s0.1, 0s0.3, 0.05s0.1, 0.1s0, 0.15s0 type=0.5/> . . . <stress strength=4 shape=–0.15s0, –0.1s0, –0.05s0.1, 0s0.3, 0.05s0.1, 0.1s0, 0.15s0 type=0.5/>. The curve 404F is the result of combining the accents represented by the curve 402 and the curve 404E. It can be seen that the peak of the curve 404F is less than the sum of the peaks of the curves 402 and 404E.

All accent tags include a "strength" parameter. The "strength" parameter of a tag influences how the accent defined by the tag influences neighboring accents. In general, strong accents, that is, accents defined by tags having a relatively high strength parameter, will tend to keep their shapes, while weak accents, having a relatively low strength parameter, will tend to be dominated by their neighbors.

Figure 5:
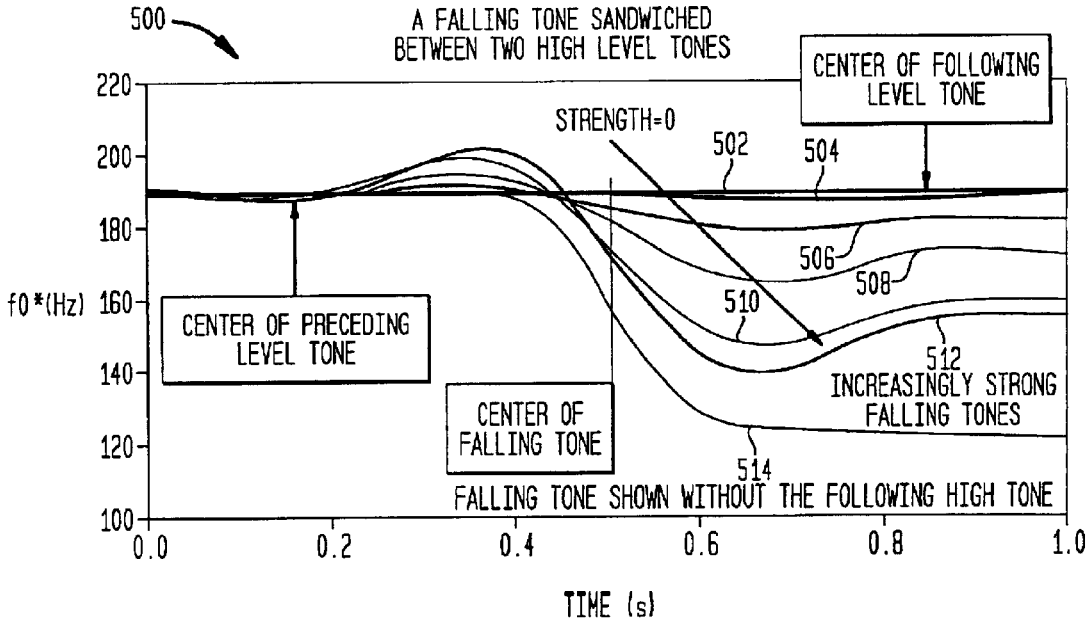
FIG. 5 is a graph illustrating the effects of variations in the strength of a tag according to the present invention.

FIG. 5 is a graph 500 illustrating the interaction between a falling tone, a preceding strong high tone and a following weak high tone as the strength of the falling tone is varied. The curves 502–512 represent the sequence of tones as the strength of the falling tone increases in strength from 0 to 5 in increments of 1. The curves 502–512 are generated by processing the series of tags <stress strength=4 type=0.3 shape=–0.1s0.3, 0.1s0.3/> . . . <stress strength=X type=0.5 shape=–0.15s0.2–0.1s0.2, 0s0, 0.1s–0.2, 0.15s–0.2/> . . . <stress strength=2.5 type=0.3, shape=–0.1s0.3, 0.1s0.3/>, where X varies from 0 to 5 in increments of 1. The curve 514 illustrates the falling tone following the strong level tone, without a following weak level tone. It can be seen that the falling tone having a strength of 0, illustrated by the curve 502, is completely dominated by its neighbors. The curves 504–512 illustrate how the falling tone tends to retain its shape as its strength increases, while its neighbors are increasingly perturbed. The shape of the falling tone illustrated in the curve 512 is nearly the same as in the curve 514, showing how the strength of the falling tone dominates the following weak level tone.

Another factor influencing phrase curves is droopiness, that is, a systematic decrease in pitch that often occurs during a phrase. This factor is represented by the parameter pdroop, which sets the rate at which the phrase curve decays toward the speaker's base frequency. Points near <step to> tags will be relatively unaffected, especially if they have a high strength parameter. This is because the decay defined by pdroop parameter operates over time, and relatively little decay will occur close to the setting of a frequency. Points farther away from a <step to> tag will be more strongly affected.

The value of "pdroop" sets an exponential decay rate of a phrase curve, so that a step will decay away in 1/pdroop seconds. Typically, a speaker's pitch trajectory is preplanned, that is, conscious or unconscious adjustments are made in order to achieve a smooth pitch trajectory. In order to model this preplanning, the pdroop parameter has the ability to cause decay in a phrase curve whether the pdroop parameter is set before or after a <step to> tag.

Figure 6:
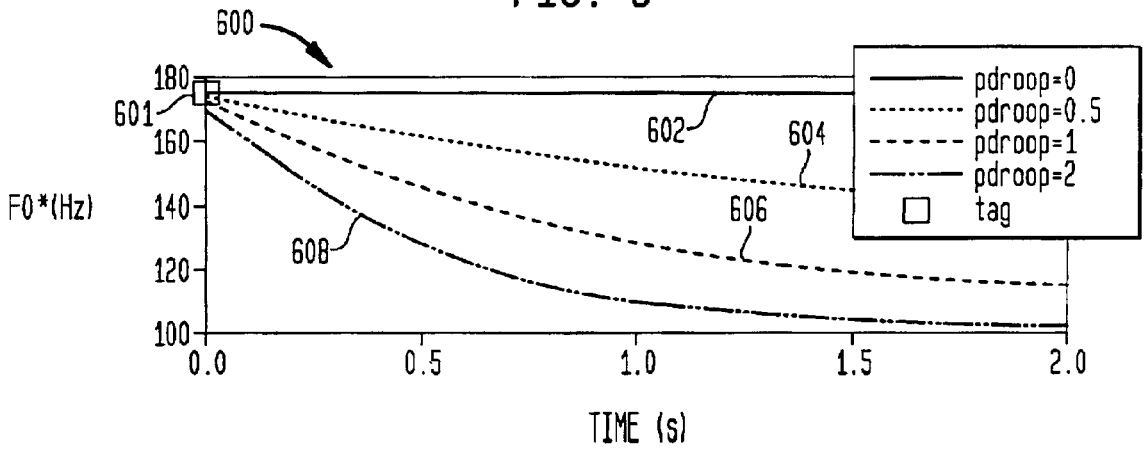
FIG. 6 is a graph illustrating the effects of different values of a "pdroop" parameter used in tags according to the present invention.

For example, FIG. 6 illustrates a graph 600 showing an occurrence of a tag sequence 601 at the beginning of a phrase, where the tag sequence includes a positive <step to> tag. The tag sequence is <set pdroop=X/> <step to=0.5 strength=3/>, where X takes on the values of 0, 0.5, 1 and 2, resulting in the phrase curves 602–608, respectively. It can be seen that the nonzero pdroop parameter used in the tags defining the curves 604–608 results in a decline of the curves 604–608 toward the base frequency of 100 Hz, with the rate of decline increasing as the value of pdroop increases.

A parameter analogous to "pdroop" is "adroop". The "adroop" parameter causes the pitch trajectory to revert to the phrase curve and thus allows limitation of the amount of preplanning assumed when processing tags. Accents farther away than 1/adroop seconds from a given point will have little effect on the local pitch trajectory around that point.

Figure 7:
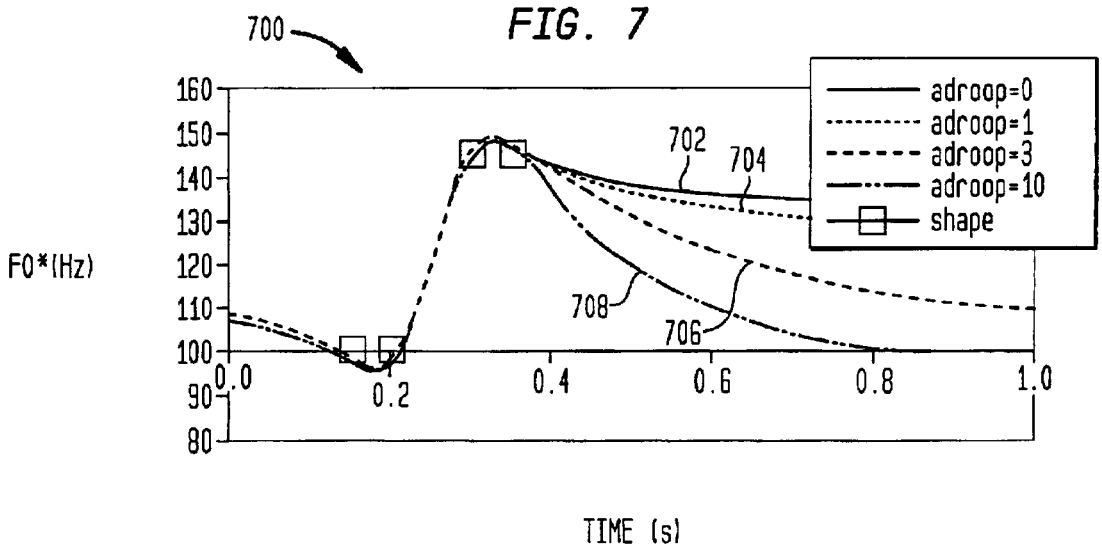
FIG. 7 is a graph illustrating the effects of different values of an "adroop" parameter used in tags according to the present invention.

FIG. 7 is a graph 700 illustrating curves 702–708 produced by processing the tag sequence <set adroop=X/> . . . <set smooth=0.08/> . . . <step to=0 strength=3/> . . . <stress shape=−0.1s0, −0.05s0, 0.05s0.3, 0.1s0.3 strength=3 type=0.5/>, where X takes on the value of 0, 1, 3 and 10, respectively. Here the pitch curve is a constant 100 Hz and the "adroop" parameter causes the curves 702–708 to decay toward the pitch curve as distance from the accent increases. The rate of decay increases as the value of "adroop" increases.

Figure 8:
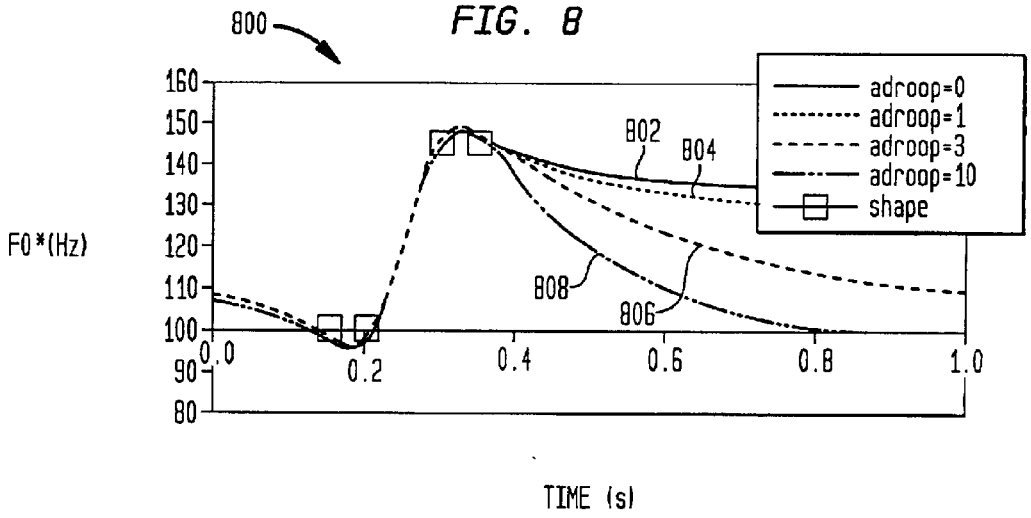
FIG. 8 is a graph illustrating the effects of different values of the parameter "smooth" used in tags according to the present inventions.

FIG. 8 is a graph 800 illustrating the curves 802–808, representing an accent having different smoothing times. The curves 802–808 are produced by processing the tag sequence <set smooth=X/> . . . <stress strength=4 shape=−0.15s0, −0.1s0, −0.05s0.1, 0s0.3, −15s0, 0.1s0, −05s0.1/>, where X takes on values of 0.04, 0.10, 0.14 and 0.2, respectively. The "smooth" parameter is preferably set to the time a speaker normally takes to change pitch, for example, to make a voluntary change in pitch in the middle of an extended vowel. The curve 808, having a "smooth" value of 0.2, is substantially oversmoothed relative to the shape of the accent.

Figure 9:
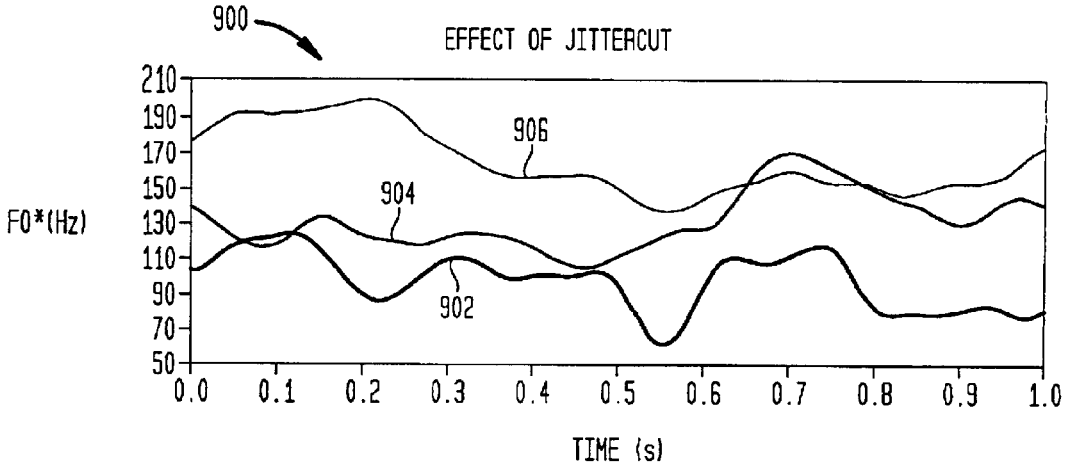
FIG. 9 is a graph illustrating the effects of different values of the parameter "jittercut" used in tags according to the present invention.

FIG. 9 is a graph 900 illustrating the effect of the "jittercut" parameter. The "jittercut" parameter is used to introduce random variation into a phrase, in order to provide a more realistic generation of speech. A human speaker does not say the same phrase or sentence in exactly the same way every time he or she says it. By using the "jittercut" parameter, it is possible to introduce some of the variation characteristic of human speakers.

The graph 900 illustrates curves 902–906, having the value of "jittercut" set to 0.1, 0.3 and 1, respectively. The value of "jittercut" used to generate the curve 902 is on approximately the scale of the mean word length and therefore produces significant variation within words. The value of "jittercut" used to generate the curve 906 is on the scale of a phrase, and produces variation over the scale of the phrase, but little variation within words.

Figure 10:
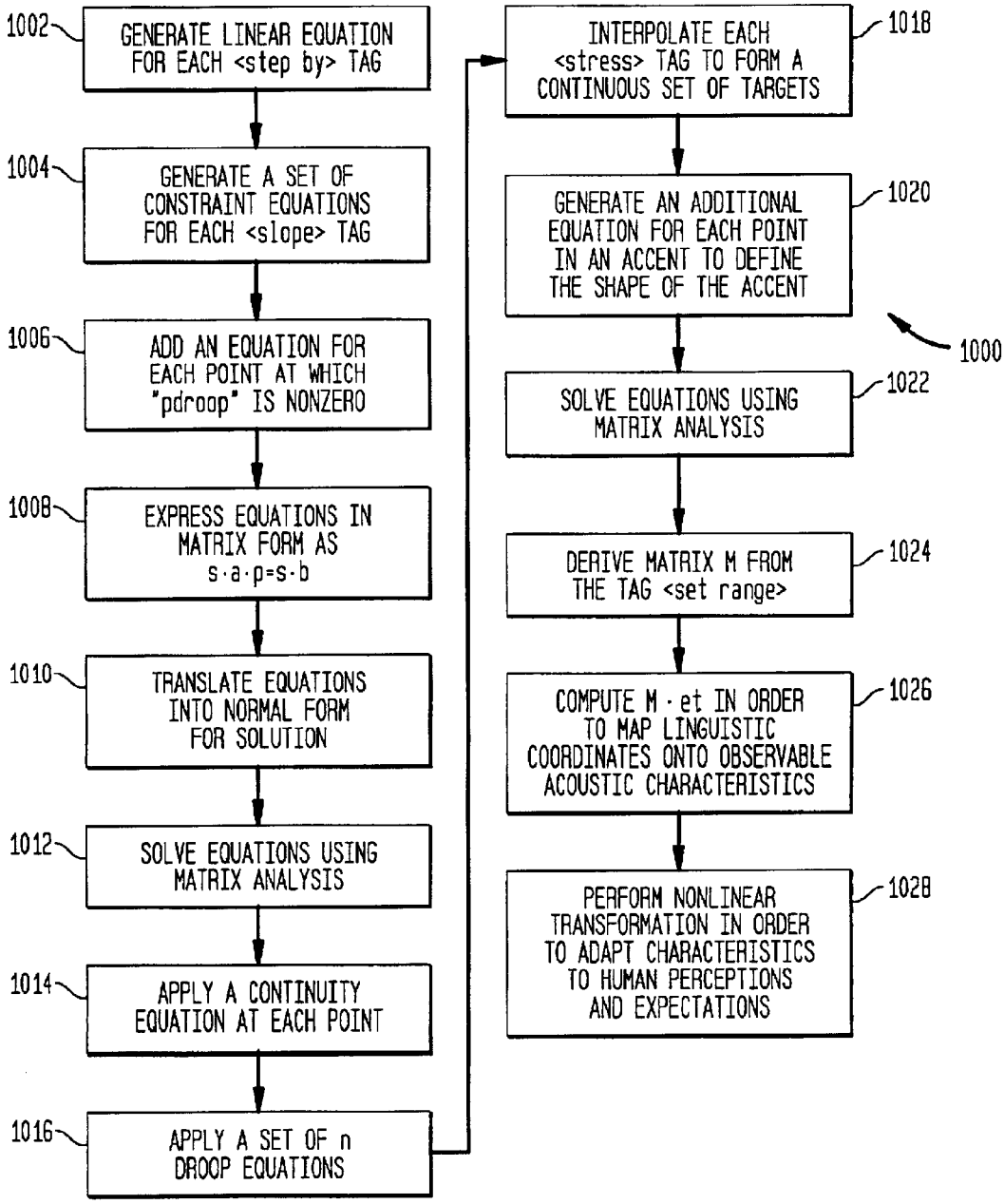
FIG. 10 illustrates the steps of a process of tag processing according to the present invention.

FIG. 10 illustrates a process 1000 of processing tags to determine values defined by the tags. The processing illustrated here is of tags whose values define prosodic characteristics, but it will be recognized that similar processing may be performed on tags defining other phenomena, such as muscular movement.

The process 1000 may be employed as step 104 of the process 100 of FIG. 1. The process 1000 proceeds by building one or more linear equations for the pitch at each instant, then solving that set of equations. Each tag represents a constraint on the prosody and processing of each tag adds more equations to the set of equations.

At steps 1002–1008, step and slope tags are processed to create a set of constraints on a phrase curve, each constraint being represented by a linear equation defined by a tag.

At step 1002, a linear equation is generated for each <step by> tag. Each equation has the form $p_{t+W}-p_{t-W}=\text{stepsize}_t$, $w=1+[\text{smooth}/2\Delta t]$ is half of the smoothing width and t is the position of the tag. Each "step to" tag adds an equation of the form $p_t=\text{target}$, where target is the value of the "to" argument.

At step 1004, a set of constraint equations is generated for each <slope> tag. One equation is added for each time t. The equations take the form $p_{t+1}-p_t=\text{slope}_t\cdot\Delta t$, where $p_t$ is the phrase curve, $\text{slope}_t$ is the "rate" attribute of the preceding <slope> tag and $\Delta t$ is the interval between prosody calculations, typically 10 ms. In the preferred implementation, these equations have a strength $s^{[slope]}=\Delta t$.

The equations generated from the <slope> tags relate each point to its neighbors. The solution of the equations yields a continuous phrase curve, that is, a phrase curve with no sudden steps or jumps. Such a continuous phrase curve reflects actual human speech patterns, whose rate of change is continuous because vocal muscles do not respond in an instantaneous way.

At step 1006 one equation is added for each point at which "pdroop" is nonzero. Each such equation tends to pull the phrase curve down to zero. Each droop equation has the form $s^{[droop]}=\text{pdroop}\cdot\Delta t$. Each equation has an individual small effect, but the effects accumulate to eventually bring the phrase curve to zero.

At steps 1008–1012, the equations are solved. Overall, there are m+n equations for n unknowns. The value of m is the number of step tags+(n−1). All the values of $p_t$ are unknown. The equations yield an overdetermination of the values of the unknowns, because there are more equations than unknown. It is therefore necessary to find a solution that approximately solves all of the equations. Those familiar with the art of solving equations will recognize that this may be characterized as a "weighted least squares" problem, having standard algorithms for its solution.

At step 1008, in the preferred implementation, the equations are expressed in matrix form as $s\cdot a\cdot p=s\cdot b$, where s is the m by m diagonal matrix of strengths, a (a is m by n) contains the coefficients of the $p_t$ in the equations, and b (which is m by 1) contains the right hand sides of the equations (the constants). P is an m by 1 column vector. Next, at step 1010, the equations are translated into normal form for solution, that is, into the form $a^t\cdot s^2\cdot a\cdot p=a\cdot s^2\cdot b$. The reason for this is that the left hand side then contains a band diagonal matrix $(a^t\cdot s^2\cdot a)$, with narrow bandwidth. That bandwidth is no larger than w, which is typically much smaller than n or m. The narrow bandwidth is important because the cost of solving the equations scales as $w^2n$ for the band diagonal case, rather than $n^3$ for the general case. In the present application, this scaling reduces the computational costs by a factor of 1000, and gives assurance that the number of CPU cycles required to process each second of speech will be constant. Finally, at step 1012, the equations are solved using matrix analysis.

Others skilled in the art will recognize that steps 1008–1012 may be replaced with other algorithms which may yield an equivalent result.

To take an example, assume a sampling interval of dt=0.01s, smooth=0.04s, pdroop=1, and the following tags:

<slope rate=1 pos=0s/>,
<step to=0.3 strength=2 pos=0s/>,
<step by=0.5 pos=0.04 strength=0.7/>.

This results in the following set of equations, where "#" and the following material on each line represent a comment and are not part of the equation:

1: p0=0.3; s1=2#step to
2: p6−p2=0.5; s2=0.7#step by
3: p1−p0=0.01; s3=1#slope
4: p2−p1=0.01; s4=1#slope
5: p3−p2=0.01; s5=1#slope
6: p4−p3=0.01; s6=1#slope
. . .
11: p0=0; s11=0.01#pdroop
12: p1=0; s12=0.01#pdroop
13: p2=0; s13=0.01#pdroop
. . .

The matrix "a" is then $$\begin{matrix} 1 & 0 & 0 & 0 & 0 & 0 & 0 & 0 & 0 \\ 0 & 0 & -1 & 0 & 0 & 0 & 1 & 0 & 0 \\ -1 & 1 & 0 & 0 & 0 & 0 & 0 & 0 & 0 \\ 0 & -1 & 1 & 0 & 0 & 0 & 0 & 0 & 0 \\ 0 & 0 & -1 & 1 & 0 & 0 & 0 & 0 & 0 \\ & & & & \ldots & & & & \\ 1 & 0 & 0 & 0 & 0 & 0 & 0 & 0 & 0 \\ 0 & 1 & 0 & 0 & 0 & 0 & 0 & 0 & 0 \\ 0 & 0 & 1 & 0 & 0 & 0 & 0 & 0 & 0 \\ & & & & \ldots, & & & & \end{matrix}$$

where each row corresponds to the left hand side of the equations above. Each column corresponds to a time value.

The right hand side of the equations above yields the "b" matrix. Each row of the "b" responds to the right hand side of one of the equations above.

$$\begin{matrix} 0.3 \\ 0.5 \\ 0.01 \\ 0.01 \\ 0.01 \\ 0.01 \\ \ldots \\ 0 \\ 0 \\ 0 \\ \ldots \end{matrix}$$

The diagonal elements of the strength $s_{i,i}$ are as follows:

$$[2\ 0.7\ 1\ 1\ 1\ 1 \ldots 0.01\ 0.01\ 0.01 \ldots],$$

where each entry corresponds to one equation.

In between minor phrases, it is important to enforce continuity in order to achieve a natural sound. This could be achieved by calculating a whole sentence at a time. This approach, however, has unwanted consequences because it allows tags at the beginning of a phrase to affect the pitch near the end of a preceding phrase. In actual human speech patterns, pitches and accents at the beginning of a phrase do not affect pitch near the end of a preceding phrase. Humans tend to end a phrase without considering what the pitch will be at the beginning of the next phrase, and then make any necessary pitch shifts during the pause between phrases or at the beginning of the following phrase.

Continuity is therefore achieved by calculating prosody one minor phrase at a time. However, rather than calculating phrases in complete isolation, the calculation of a phrase looks back to values of $p_t$ near the end of the previous phrase, and substitutes them into the equations as known values.

The next phase of processing the tags is to calculate a pitch curve. The pitch curve includes a description of the pitch behavior of individual words and other smaller elements of a phrase, superposed on the phrase as a whole. The pitch trajectory is calculated based on the phrase curve and <stress> tags. The algorithm discussed above with respect to process steps 1002–1012 is applied, but with a different set of equations.

At step 1014, continuity equations are applied at each point, expressed in the form $e_{t+1}-e_t=0$, as well as an additional set of equations which expresses smoothness, expressed in the form $-e_{t+1}+2e_t-e_{t+1}=0$. Each such equation has a strength $s^{[smooth]}=\pi/2\cdot\text{smooth}/\Delta t$. The smoothness equations imply that there are no sharp comers in the pitch trajectory. Mathematically, the "smoothness" equations ensure that the second derivative stays small. This requirement results from the physical constraint that the muscles used to implement prosody all have a nonzero mass, therefore they must be smoothly accelerated and cannot respond jerkily.

At step 1016, a set of n "droop" equations is applied. These equations influence the pitch trajectory, similar to the way in which droop equations influence the phrase curve, as discussed above. Each "droop" equation has the form $e_t-p_t=0$, with a strength of $s^{[droop]}=\text{adroop}\cdot\Delta t$. These equations droop the pitch trajectory toward the phrase curve, as opposed to the pdroop parameter discussed above, which tends to pull the phrase curve toward zero.

At steps 1018–1020, one equation is introduced for each <stress> tag. Each such equation constrains the shape of the pitch trajectory. At step 1018, the shape of the <stress> tag is first linearly interpolated to form a contiguous set of targets. An accent defined by shape=$t_0$, $x_0$, $t_1$, $x_1$, $t_2$, $x_2$, . . . $t_j$, $x_j$ is interpolated to $X_k$, $X_{k+1}$, $X_{k+2}$, . . . , $X_j$, where $k=t_0/\Delta t$ is the index of the first point of the shape of the accent and $J=t_j/\Delta t$ is the index at the end of the accent. If the scope of the accent would extend outside the phrase, then the series $X_k$, . . . , $X_J$ is truncated at one or both ends, and the indices k and J are appropriately adjusted to mark the range of X that is inside the phrase. Other interpolation techniques may also be employed. Examples of commonly used interpolation techniques may be found in chapter 3 of W. H. Press, S. A. Teukolsky, W. T. Vetterling, and B. P. Flannery, *Numerical Recipes: the Art of Scientific Computing*, Second edition, 1992, Cambridge University Press, ISBN 0-521-43108-5.

Under some conditions, it may be advantageous to represent the shapes as, for instance, sums over orthogonal functions, rather than as a set of (t,x) points and an interpolation rule. A particularly advantageous example might be a Fourier expansion, where the shape is a weighted sum of sine and cosine functions. In such a case, the "shape"

parameter in XML would contain a list of coefficients to multiply the functions in an expansion of the shape.

The equation that constrains the mean pitch of the accent is $$\sum_{i=k}^{J} e_i = \sum_{i=k}^{J} (X_i + p_i),$$

with $s^{[pos]}$=(strength/(J−K))·sin(type·π/2). As "type" increases from 0, it can be seen that the strength of this equation also increases from zero (meaning that the accent preserves shape at the expense of mean pitch) to "strength" (meaning that the accent preserves mean pitch at the expense of shape).

At step 1020, an additional equation is also generated for each point, that is, from k to J in the accent. These equations define the shape of the accent and take the form $$e_i - \bar{e} = X_i - \bar{X} + p_i - \bar{p}, \text{ where } e = \sum_{i=k}^{J} \bar{e}_i / (J - k + 1)$$

is the average value of the pitch trajectory over the accent, $$\bar{p} = \sum_{i=k}^{J} p_i / (J - k + 1)$$

is the average phrase curve under the accent, $$\text{and } \bar{X} = \sum_{i=k}^{J} X_i / (J - k + 1)$$

is the average shape of the accent. Subtracting the averages prevents these equations from constraining whether the accent sits above or below the phrase curve. Instead, the equations constrain only the shape of the accent. Each accent has a "strength" value of $s^{[shape]}$=j·strength·cos(type·π/2)/(J−k+1). At step 1022, the equations are solved using matrix analysis similar to that discussed in the example above.

The constraint equations can be thought of as an equivalent optimization problem. The equation $E=(a\cdot p-b)^t\cdot s^2\cdot(a\cdot p-b)$ gives a minimum value of E for the same value p that solves the constraint equations. The value of p can therefore be determined by minimizing E. The equation for E, above, can be broken into segments by selecting groups of rows of a and b. These groups correspond to groups of constraint equations, and E will be a sum over groups of smaller versions of the same quadratic form. Continuity, smoothness, and droop equations can be placed in one group, which can be understood as related to effort required to produce speech with desired prosodic characteristics. Constraint equations resulting from tags can be placed in another group, which can be understood as related to preventing error, that is, in producing clear and unambiguous speech. The value of E can then be understood as E=effort+error. Qualitatively, the "effort" term behaves like the physiological effort. It is zero if the muscles are stationary in a neutral position, and increases as muscular motions become faster and stronger. Likewise, the "error" term behaves like a communication error rate: it is minimal if the prosody exactly matches the ideal target, and increases as the prosody deviates from the ideal. As the prosody deviates from the ideal, one expects the listener to have an increasingly large chance of misidentifying the accent or tone shape. It is a reasonable assumption that human speech should represent an attempt at minimization of a combination of the effort of speaking and the likelihood of being misunderstood. Minimizing the error rate (that is, the chance of misinterpretation of speech) is desirable and reducing the effort of speaking is also a desirable goal. The minimization of the value of E achieved by the techniques of the present invention may be regarded as reflecting tendencies and compromises characteristic of genuine human speech.

The tags, as described above, are primarily shown as controlling a single parameter or aspect of motion or speech production, with each of the values that expresses a control parameter being a scalar number. However, the invention can easily be adapted so that one or more of the tags controls more than one parameter, with vector numbers being used as control parameters. In the vector case, the above computations are carried out separately for each component of the vector. First a phrase curve $p_t$ is calculated and then $e_t$ is calculated independently for each component. Independent calculations may, however, use data from the same tags. After $e_t$ has been calculated for each component, individual calculations for $e_t$ at time t are then concatenated to form a vector $e_t$ is. Conversely, if only one parameter is being controlled, it can be treated as a 1-component vector in the calculations that follow.

After the pitch curve is calculated, the process continues and linguistic concepts represented by the phrase curve and the pitch curve are mapped onto observable acoustic characteristics. Mapping is accomplished by assuming statistical correlations between the predicted time varying emphasis $e_t$ and observable features which can be detected in or generated for a speech signal. Because $e_t$ is typically a vector, mapping can be accomplished by multiplying $e_t$ by a matrix M of statistical correlations.

At step 1024, the matrix M is derived from the tag <set range>. Next, at step 1026, $e_t\cdot M$ is computed. At step 1028, nonlinear transformation is performed on the result of step 1028, that is, on $e_t\cdot M$, in order to adjust the prosodic characteristics defined by the tags to human perceptions and expectations. The transformation is defined by the <set add> tag. The transformation is expressed by the function $f(x)=\text{base}\cdot(1+\gamma+x)^{1/add}$, where $\gamma=(1+(\text{range}/\text{base}))^{add}-1$. The value of f(0) is equal to the value "base" and the value of f(1) is equal to the value of "base+range".

The relationship between pitch, measured as frequency, and the perceptual strength of an accent is not necessarily linear. Moreover, the relationship between neural signals or muscle tensions and pitch is not linear. If perceptual effects are most important, and a human speaker adjusts accent so that they have an appropriate sound, it is useful to view a pitch change as the smallest detectable frequency change. The value of the smallest detectable frequency change increases as frequency increases. According to one widely accepted estimation, the relation between the smallest detectable frequency change and frequency is given as $DL\propto e^{\sqrt{f}}$, where DL is the smallest detectable frequency change, e is the root of the natural logarithm and f is the frequency, or pitch. In the system of tags and processing of tags according to the present invention, this relationship corresponds to some relationship between accent strength and frequency that is intermediate between linear and exponential, described by a <set add> tag where the value of "add" is approximately 0.5. On the other hand, if a system is implemented which models speech on the assumption that the speaker does not adapt himself or herself for the listener's convenience, other values of "add" are possible and values of "add" which are greater than 1 can be used. For example, if muscle tensions are assumed to add, the value of the pitch f0 is approximately equal to the value √tension.

Each observable can have a different function, controlled by the appropriate component of the <set add> tag. Amplitude perception is roughly similar to the perception of pitch in that both have a perceived quantity that increases slowly as the underlying observable changes. Both amplitude and pitch are expressed by an inverse function that increases nearly exponentially with the desired perceptual impact.

The function described above, that is, $f(x)=\text{base}\,(1+\gamma+x)^{1/add}$ smoothly describes linear behavior when the value of "add" is 1. The function describes exponential behavior when the value of "add" approaches 0, and describes behaviors in between linear and exponential when the value of "add" is between 1 and 0 or an approach to 0.

Figure 11:
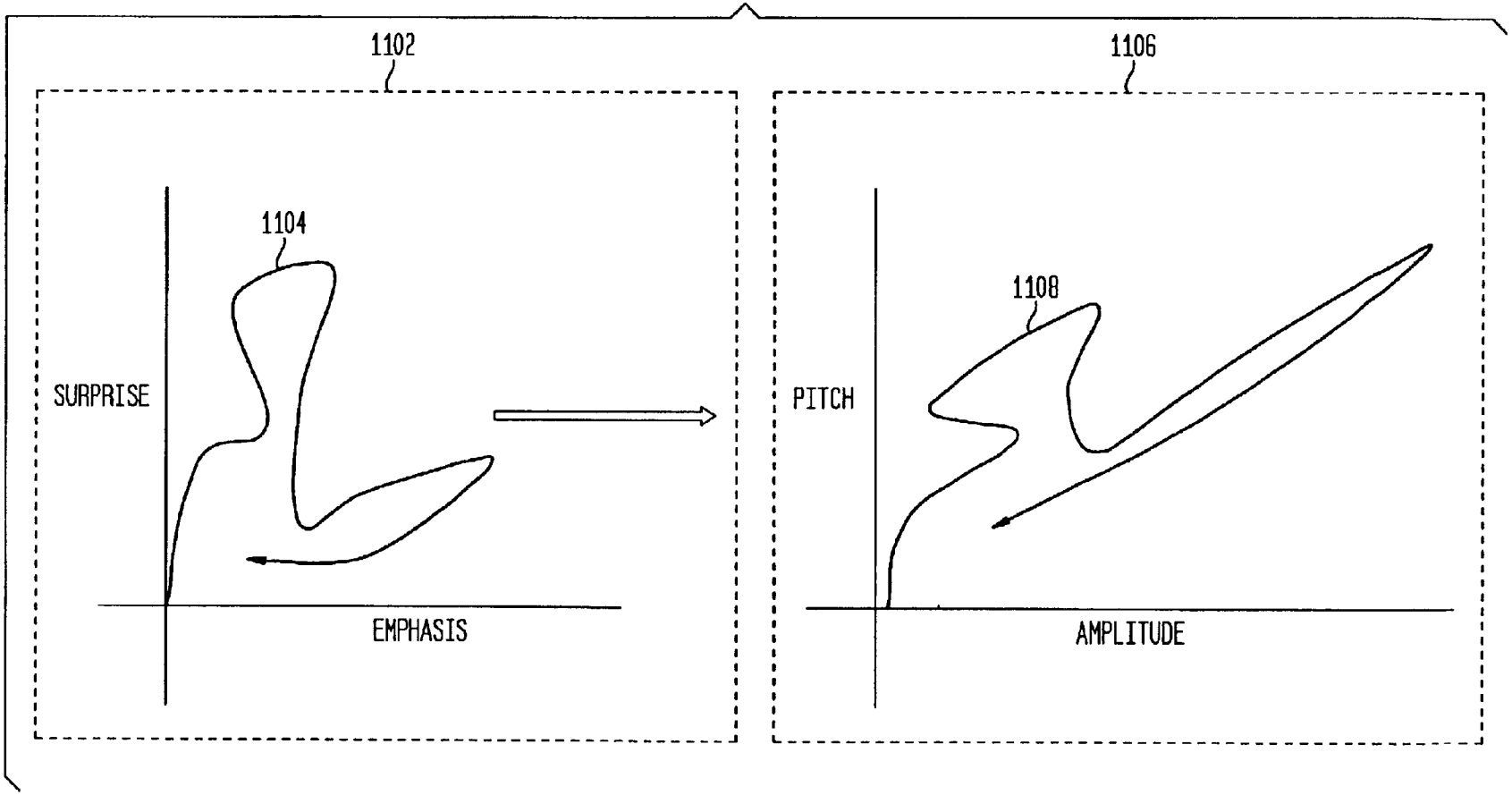
FIG. 11 is a graph illustrating an example of mapping linguistic coordinates to observable acoustic characteristics according to the present invention.

FIG. 11 illustrates an example of mapping of linguistic coordinates to observable acoustic characteristics, discussed in connection with steps 1024–1026 of FIG. 10, above. The graph 1102 illustrates a curve 1104 plotting surprise against emphasis. The graph 1106 illustrates a curve 1106 plotting pitch against amplitude. The curve 1104 maps to the curve 1106. This mapping is made possible by the matrix multiplication discussed above in connection with steps 1024–1026 of FIG. 10.

The use of the matrix M expressing correlations between $e_t$ and observable features is merely an approximation. It is appropriate if the correlations are approximately linear or relatively weak. Especially for correlations of $e_t$ with subjective qualities like anger or suspicion, it is likely that the linear correlations given by the multiplication $e_t \cdot M$ are all that will be available.

In some situations, such as modeling of finger motion, the above approximation is insufficient, and better models for the correlations can be made. For instance, one skilled in the art could build a model of a hand, where the values of $e_t$ correspond to muscle extensions, and the bones in the hand could be modeled by a series of rigid bars connected by joints. In such a case, observable quantities such as the position of a fingertip, would be a nonlinear, but analytic, function of the muscle extensions. Such specific models may be built where appropriate. If such a model is built, steps similar to steps 1024–1028 of FIG. 10 would not be performed and the results of correlating $e_t$ and observable properties would be an arbitrary function of the $e_t$ vector at each time.

For some applications, it may be possible and appropriate that the correlations between $e_t$ and observable properties will be a function of the $e_t$ vector over a range of times. This could be useful if, for example, one observable depends on $e_t$, and another on the rate of change of $e_t$. Then, to take an example, the first observable could be calculated as $e_t$, and the second as $(e_t-e_{t-1})$. As a concrete example, consider the tail of a fish. The fin is controlled by a set of muscles, and the base of the fin could be modeled as moving in response to the $e_t$ calculated similarly to the calculations of $e_t$ discussed with respect to FIG. 10 above. However, in reality the fin of a fish is flexible, and moving in water. As the fin moves through the water, hydrodynamic forces cause the fin to bend, so that the position of the end of the fin cannot be predicted simply from the present value of $e_t$. In a simple model, where the fin is considered to move without inducing turbulence in the water, and where the mechanical properties of the fin are those of a stiff linear spring, the end of the fin would be at a position $A \cdot e_t + B \cdot (e_t - e_{t-1})$, where A is related to the length of the fin, and B is a function of the size of the fin, the stiffness, and the viscosity of water.

Figure 12:
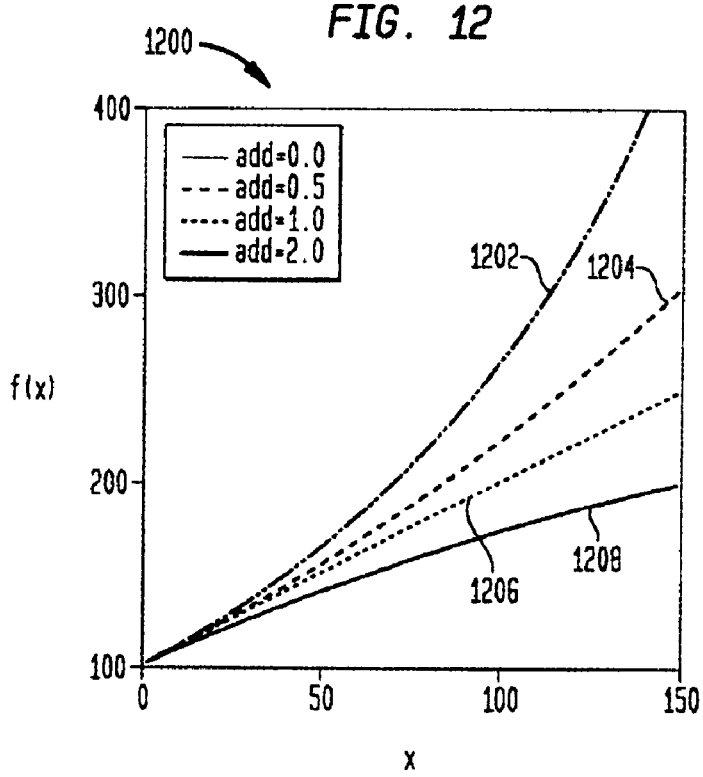
FIG. 12 is a graph illustrating the effect of a nonlinear transformation performed in text to speech processing according to the present invention.

FIG. 12 is a graph 1200 illustrating the result of a linear transformation similar to that described in connection with step 1028 of FIG. 10. The curves 1202–1208 represent traces of the function f(x), having values of "add" of 0.0, 0.5, 1.0 and 2.0, respectively. The curve 1202, having a value of "add" of 0, shows an exponential relationship, the curve 1206, where the value of "add" is 1, shows a linear relationship, and the curve 1208, where the value of "add" is 2, shows a growth rate slower than linear.

Figure 13:
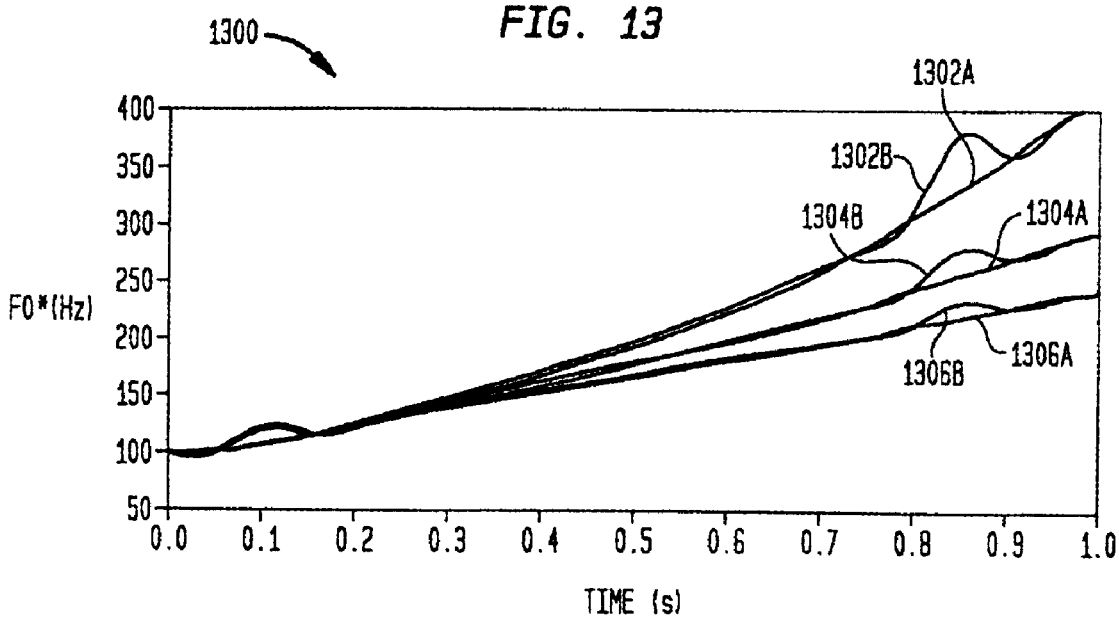
FIG. 13 is a graph illustrating the effects of different values of the parameter "add" used in tags according to the present invention.

FIG. 13 is a graph 1300 illustrating the effects of accents on a pitch curve for different values of "add." The graphs 1302A, 1304A and 1306A illustrate the effects of the tag sequence <set add=X/> . . . <slope rate=1/>, where the value of X is 0 for the curve 1302A, 0.5 for the curve 1304A and 1 for the curve 1306A. it can be seen that the curve 1302A illustrates an exponential relationship while the curve 1306A illustrates a linear relationship.

The curves 1302B, 1304B and 1306B illustrate the effects of the tag sequence <set add=X/> . . . <slope rate=1/>, with the added sequence of tags <stress strength=3 type=0.5 shape=−0.1s0, 0.05s0, 0s0.1, 0.05s0, 0.1s0/> . . . <stress strength=3 type=0.5 shape=−0.1s0, 0.05s0, 0s0.1, 0.05s0, 0.1s0/>. The value of X is 0 for the curve 1302B, 0.5 for the curve 1304B and 1 for the curve 1306B. It can be seen that the effect of the first accent is similar for each of the curves 1302B, 1304B and 1304C. The reason for this is that the first accent occurs at a relatively low frequency, so that the differing effects of the different values of "add" are not particularly pronounced. A higher value of "add" causes a more pronounced effect when the frequency is higher, but does not cause a particularly pronounced effect at lower frequencies. The second accent, however, produces significantly differing results for each of the curves 1302B, 1304B and 1304C. As the frequency increases, it can be seen that the accents cause larger frequency excursions as the value of "add" decreases.

The following examples show the generation of Mandarin Chinese sentences from the tags of the current invention. Mandarin Chinese is a tone language with four different lexical tones. The tones may be strong or weak, and the relative strength or weakness of tones affects their shape and their interactions with neighbors. FIG. 14 A–H shows how the pitch over the sentences changes in eight conditions, comprising each of four different tones in a strong and a weak contexts. The interactions of tones with their neighbors can be represented with tags controlling the strengths of the syllables in sentences as shown below.

| Chinese word | English translation | Strength | Type |
|---|---|---|---|
| shou- | radio | 1.5 | 0.5 |
| yin- | — | 1.0 | 0.2 |
| ji | — | 1.0 | 0.3 |
| duo | more | 1.1 | 0.5 |
| ying- | should | 0.8 | 0.2 |
| gai | — | 0.8 | 0.3 |
| deng | lamp | 1.0 | 0.5 |
| bi- | comparatively | 1.5 | 0.5 |
| jiao | — | 1.0 | 0.3 |
| duo | more | 1.0 | 0.5 |

The values for "strength" and "type" were derived from a training sentence including the words shou1 yin1 ji1, where "1" indicates Tone 1 of Mandarin Chinese, that is, a level tone.

These tags are used for four FIGS. 14 E–H (shou1 yin ji1) with four different tones in the second syllable of the sentence. For the shorter "Yan" sentences shown in FIGS. 14 A–D, the three syllable word "shou1 yin/ying ji" is replaced by a monosyllabic word "Yan". The remainder of each sentence is the same. The tags of the syllable "Yan" are: strength=1.5, type=0.5, which are the same as the strongest syllable of the three syllable word "Shou" in "Shou yin ji".

Figure 14A:
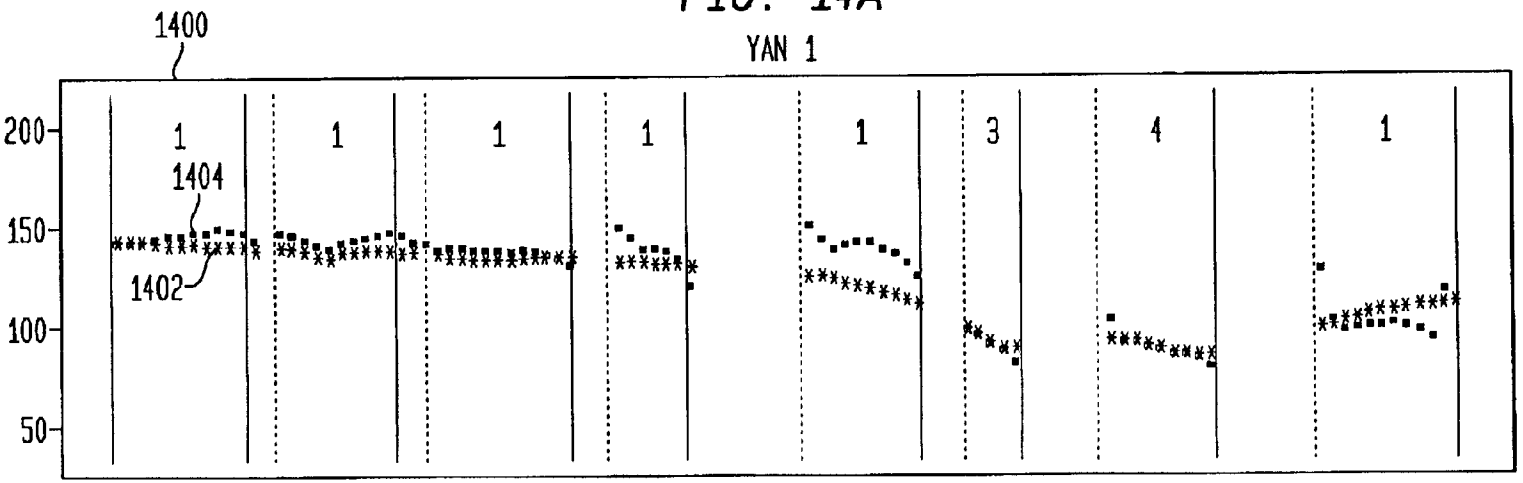
FIG. 14 is a graph illustrating the modeling of exemplary data using tags according to the present invention.

FIG. 14A is a graph 1400 illustrating a curve 1402 representing modeling of the word "Yan1," in a sentence by the use and processing of tags according to the present invention. "Yan1" is the word "Yan" spoken with tone 1, a level tone. The curve 1404 represents data produced by a speaker producing the sentence with the word "Yan1" in the beginning of the sentence. The word "Yan1", being a monosyllabic word, has a strong strength and therefore its pitch curve displays little influence from other nearby words.

Figure 14B:
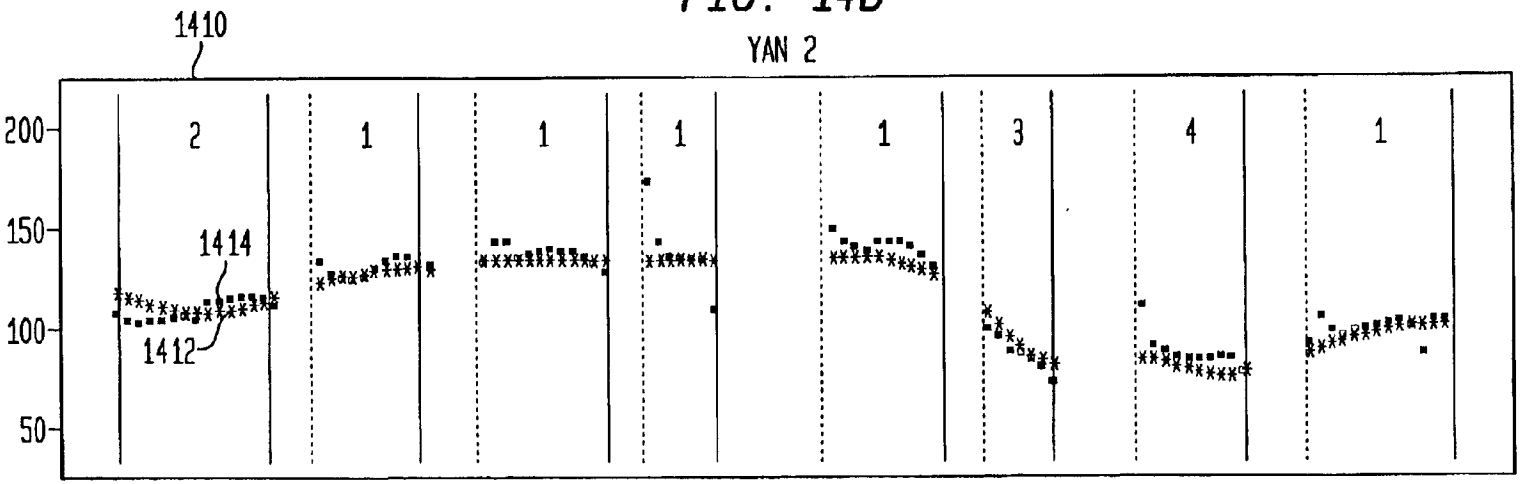

FIG. 14B is a graph 1410 illustrating a curve 1412 representing modeling of the word "Yan2," in a sentence by the use and processing of tags according to the present invention. "Yan2" is the word "Yan" spoken with tone 2, a rising tone. The curve 1414 represents data produced by a speaker producing the sentence with the word "Yan2" in the beginning of the sentence. The word "Yan2", being a monosyllabic word, has a strong strength and therefore its pitch curve displays little influence from other nearby words.

Figure 14C:
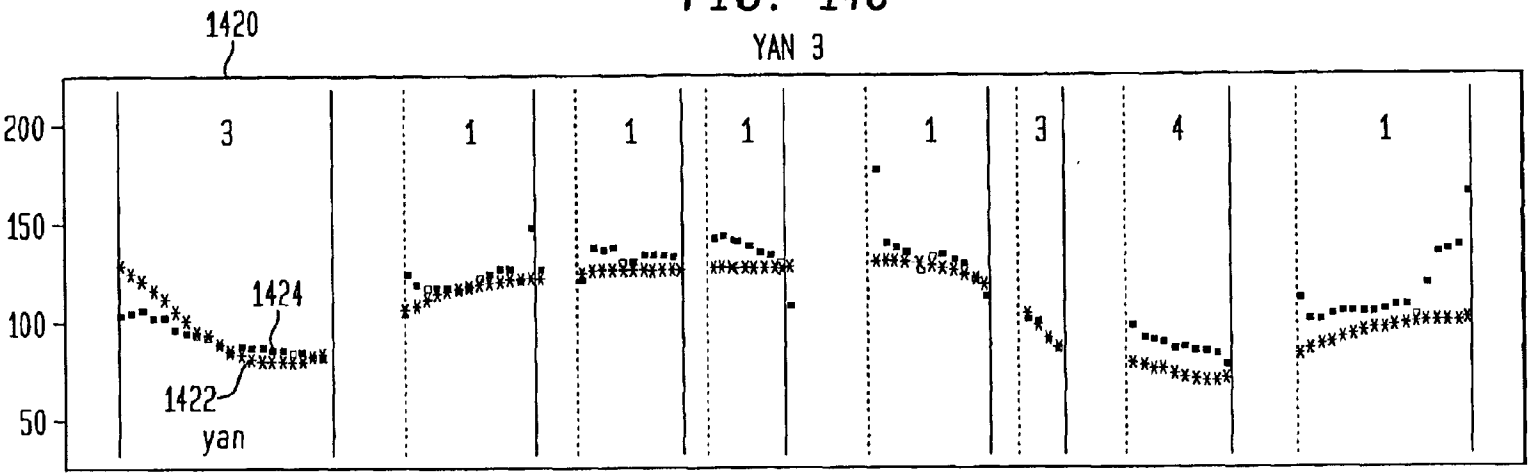

FIG. 14C is a graph 1420 illustrating a curve 1422 representing modeling of the word "Yan3," in a sentence by the use and processing of tags according to the present invention. "Yan3" is the word "Yan" spoken with tone 3, a low tone. The curve 1424 represents data produced by a speaker producing the sentence with the word "Yan3" in the beginning of the sentence. The word "Yan3", being a monosyllabic word, has a strong strength and therefore its pitch curve displays little influence from other nearby words.

Figure 14D:
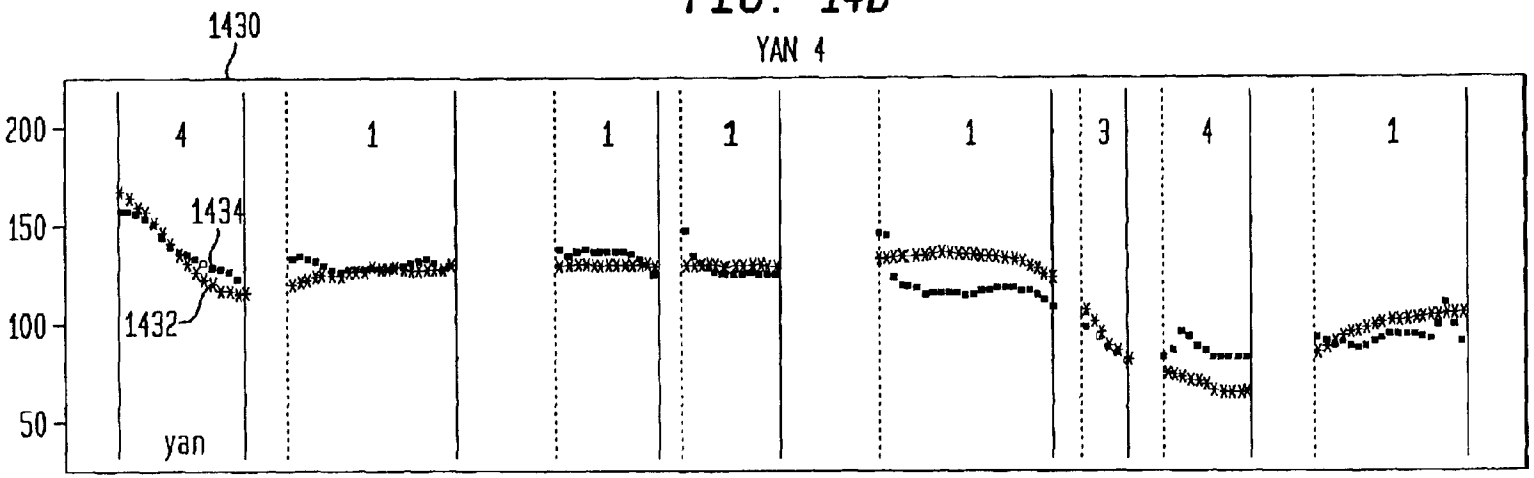

FIG. 14D is a graph 1430 illustrating a curve 1432 representing modeling of the word "Yan4," in a sentence by the use and processing of tags according to the present invention. "Yan4" is the word "Yan" spoken with tone 4, a falling tone. The curve 1434 represents data produced by a speaker producing the sentence with the word "Yan1" in the beginning of the sentence. The word "Yan4", being a monosyllabic word, has a strong strength and therefore its pitch curve displays little influence from other nearby words.

Figure 14E:
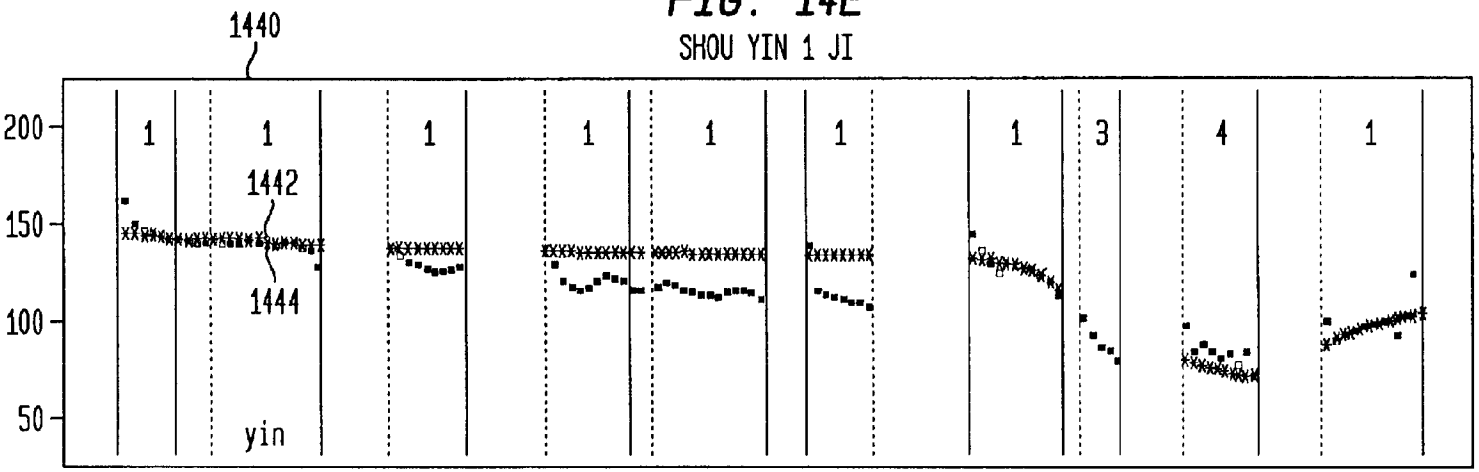

FIG. 14E is a graph 1440 illustrating a curve 1442 representing modeling of the word "Shou1 yin1 ji1" in a sentence by the use and processing of tags according to the present invention. "Yin1" is the syllable "Yin" spoken with Tone 1, a level tone. The curve 1444 represents data produced by a speaker producing the sentence with the word "Shou1 yin1 ji1" in the beginning of the sentence. The syllable "Yin1", being the middle syllable of a three syllable word, has a weak strength and therefore its pitch curve displays strong influence from other nearby syllables.

Figure 14F:
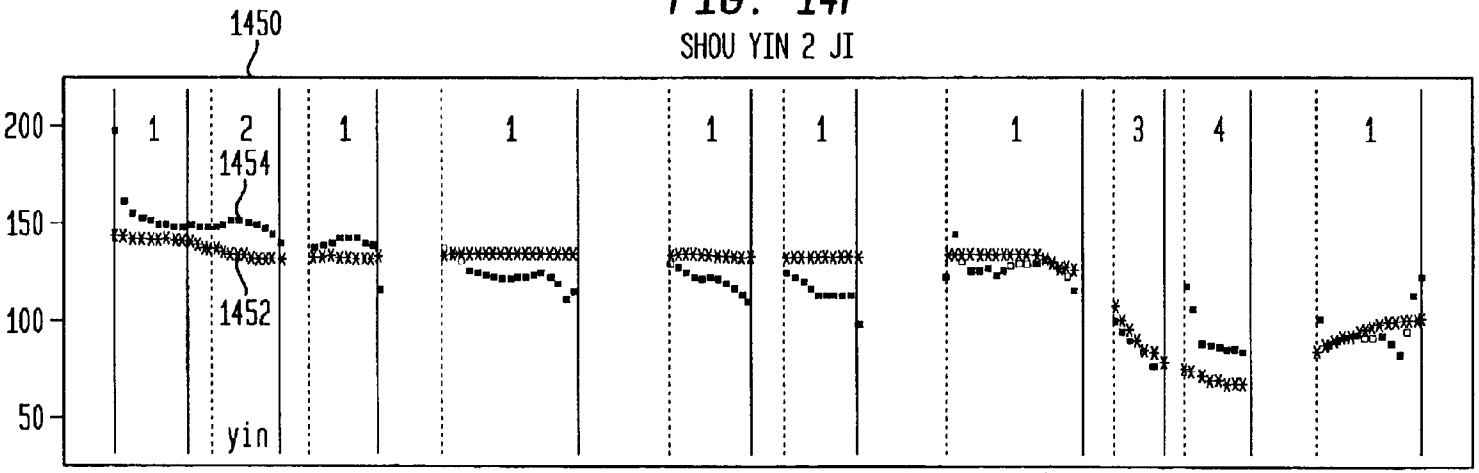

FIG. 14F is a graph 1450 illustrating a curve 1452 representing modeling of the word "Shou1 yin2 ji1" in a sentence by the use and processing of tags according to the present invention. "Yin2" is the syllable "Yin" spoken with Tone 2, a rising tone. The curve 1454 represents data produced by a speaker producing the sentence with the word "Shou1 yin2 ji1" in the beginning of the sentence. The syllable "Yin2", being the middle syllable of a three syllable word, has a weak strength and therefore its pitch curve displays strong influence from other nearby syllables, in comparison to "Yan2" in FIG. 14B.

Figure 14G:
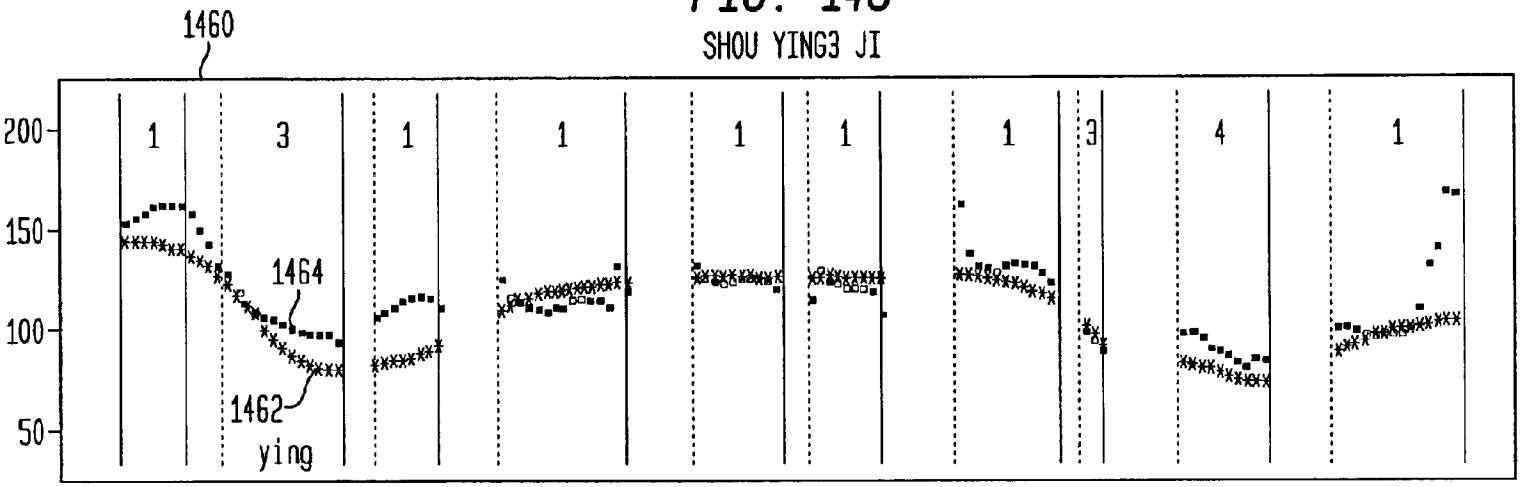

FIG. 14G is a graph 1460 illustrating a curve 1462 representing modeling of the word "Shou1 ying3 ji1" in a sentence by the use and processing of tags according to the present invention. "Ying3" is the syllable "Ying" spoken with Tone 3, a low tone. The curve 1464 represents data produced by a speaker producing the sentence with the word "Shou1 ying3 ji1" in the beginning of the sentence. The syllable "Ying3", being the middle syllable of a three syllable word, has a weak strength and therefore its pitch curve displays strong influence from other nearby syllables, in comparison to "Yan3" in FIG. 14C.

Figure 14H:
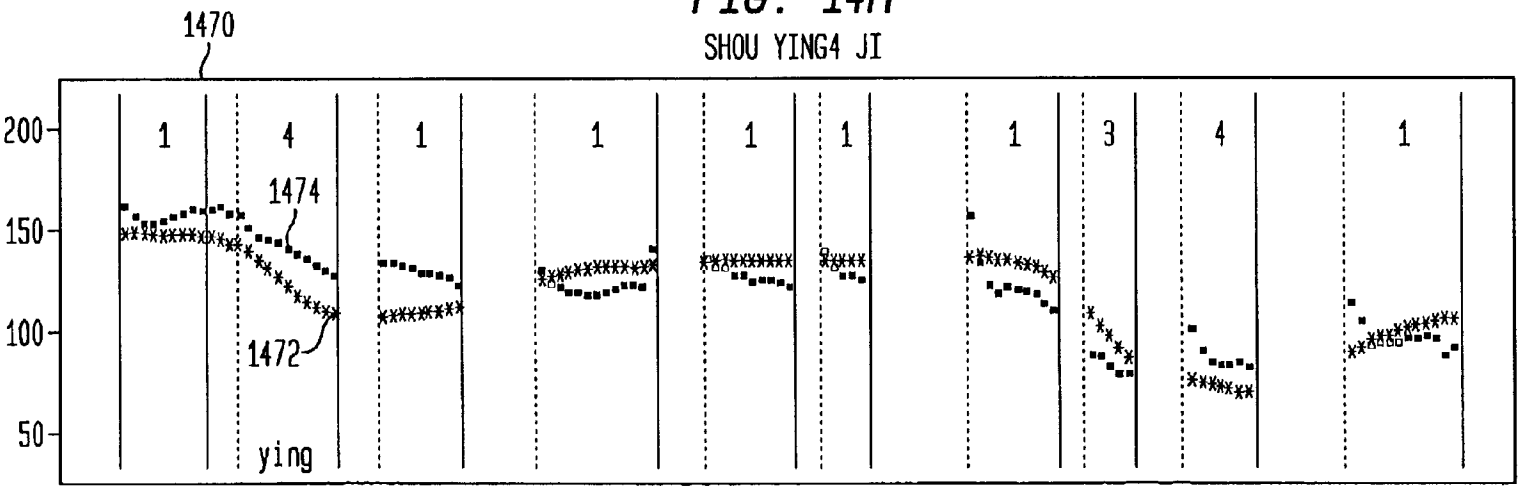

FIG. 14H is a graph 1470 illustrating a curve 1472 representing modeling of the word "Shou1 ying4 ji1" in a sentence by the use and processing of tags according to the present invention. "Ying4" is the syllable "Ying" spoken with Tone 4, a level tone. The curve 1474 represents data produced by a speaker producing the sentence with the word "Shou1 ying4 ji1" in the beginning of the sentence. The syllable "Ying4", being the middle syllable of a three syllable word, has a weak strength and therefore its pitch curve displays strong influence from other nearby syllables, in comparison to "Yan4" in FIG. 14D.

It can be seen from the curves illustrated in FIGS. 14A–14H that the curves representing modeling processing of text using tags according to the present invention provide a good approximation to the curves representing actual spoken words, even when the strengths of the tags are not fitted to each individual sentence.

Figure 15:
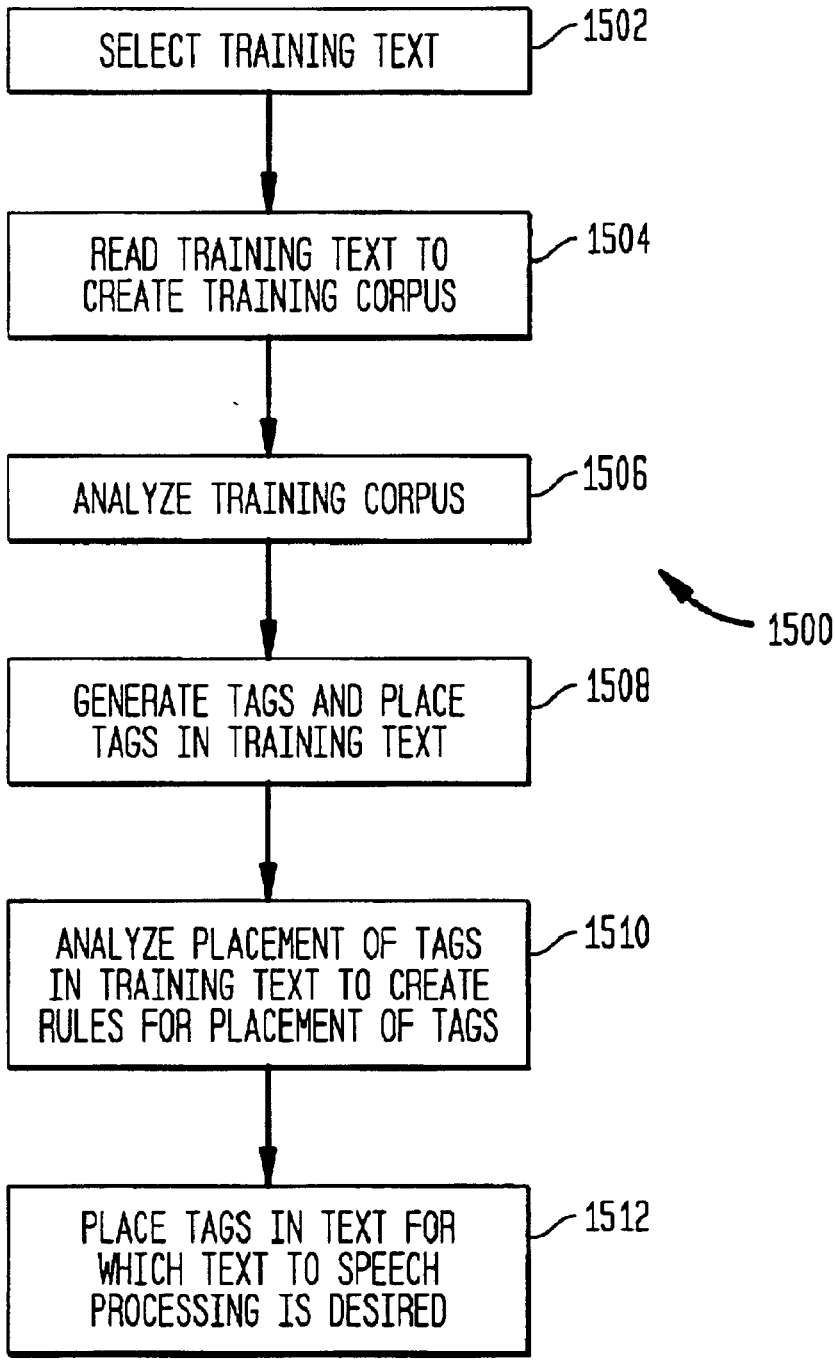
FIG. 15 illustrates a process of developing and using tags according to the present invention.

FIG. 15 illustrates the steps of a process 1500 of generation and use of tags according to the present invention. At step 1502, a body of training text is selected. At step 1504, the training text is read by a target speaker to produce a training corpus. At step 1506, the training corpus is analyzed to identify prosodic characteristics of the training corpus. At step 1508, a set of tags is generated to model the prosodic characteristics of the training corpus and tags are placed in the training text in such a way as to model the training corpus. At step 1510, the placement of the tags in the training text is analyzed to produce a set of rules for the placement of tags in text so as to model the prosodic characteristics of the target speaker. At step 1512, tags are placed in a body of text on which it is desired to perform text to speech processing. The placement of the tags may be accomplished manually, for example, through the use of a text editor, or may alternatively be accomplished automatically using the set of rules established at step 1510. It will be recognized that steps 1502–1510 will typically be performed once or a few times for each target speaker, while step 1512 will be performed whenever it is desired to prepare a body of text for text to speech processing.

Figure 16:
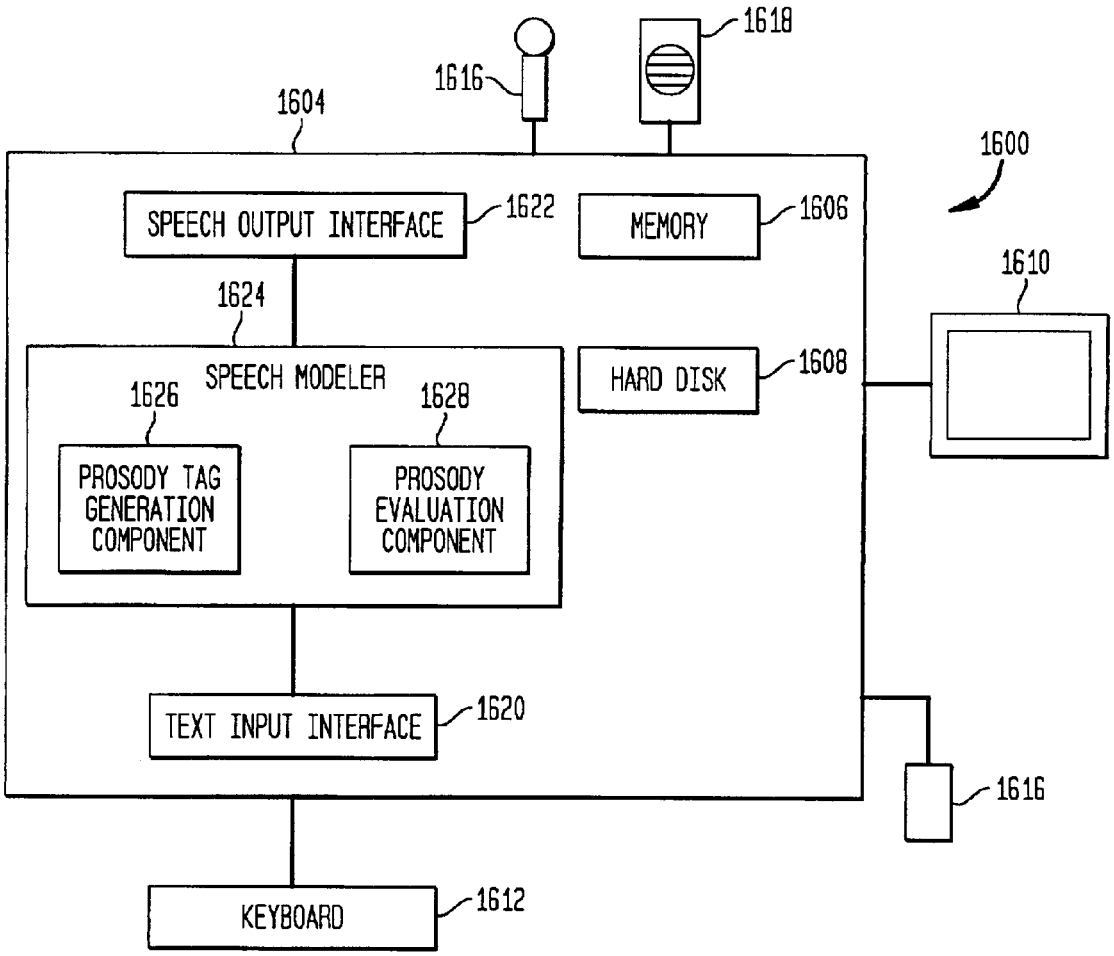
FIG. 16 illustrates an exemplary text to speech system according to the present invention.

FIG. 16 illustrates a text to speech system 1600 according to the present invention. The system 1600 includes a computer 1602 including a processing unit 1604 including memory 1606 and hard disk 1608, monitor 1610, keyboard 1612 and mouse 1614. The computer 1602 also includes a microphone 1616 and loudspeaker 1618. The computer 1602 operates to implement a text input interface 1620 and a speech output interface 1622. The computer 1602 also provides a speech modeler 1624, adapted to receive text from the text input interface 1620, the text having tags generated and placed in the text according to the present invention. The speech modeler 1624 operates to process the text and tags to produce speech having prosodic characteristics defined by the tags and output the speech to the loudspeaker 1618 using the speech output interface 1622. The speech modeler 1624 may suitably include a prosody tag generation component 1626 adapted to generate a set of tags and rules for applying tags in order to produce speech having prosodic characteristics typical of a target speaker. In order to generate the set of tags, the prosody tag generation component 1626 analyzes a training corpus representing reading of a training text read by a target speaker, analyzes the prosodic characteristics of the training corpus, and generates a set of tags which can be added to the training text to model the training corpus. The prosody tag generation component 1626 may then places the tags in the training text and analyzes the placement of the tags in order to develop a set of rules for placement of tags in text in order to model the speaking characteristics of the target speaker.

The speech modeler 1624 may also suitably include a prosody evaluation component 1628, used to process tags placed in text for which text to speech generation is desired. The prosody evaluation component 1628 produces a time series of pitch or amplitude values as defined by the tags.

The system of generating and processing tags described above is a solution to an aspect of a more general problem. The act of speech is an act of muscular movement in which a balance is achieved between two primary goals, that of minimizing the effort required to produce muscular movement and the motion error, that is, the deviation between the motion desired and the motion actually achieved. The system of generating and processing tags described above generally produces smooth changes in prosody, even in cases of sharply conflicting demands of adjacent tags. The production of smooth changes reflects the reality of how muscular movement is achieved, and produces a balance between effort and motion error.

It will be recognized that the system of generation and processing of tags according to the present invention allows a user to create tags defining accents without any shape or scope restriction on the accents being defined. Users thus have the freedom to create and place tags so as to define accent shapes of different languages as well as variations within the same language. Speaker specific accents may be defined for speech. Ornamental accents may be defined for music. Because no shape or scope restrictions are imposed on the user's creation of accent definitions, the definitions may result in a physiologically implausible combination of targets. The system of generating and processing tags according to the present invention accepts conflicting specifications and returns smooth surface realizations that compromise between the various constraints.

The generation of smooth surface realizations in the face of conflicting specifications helps to provide an accurate realization of actual human speech. The muscle motions that control prosody in actual human speech are smooth because it takes time to make a transition from one intended accent target to the next. It will also be noted that when a section of speech material is unimportant, the speaker may not expend much effort to realized the targets. The surface realization of prosody may therefore be represented as an optimization problem minimizing the sum of two functions. The first function is a physiological constraint G, or "effort", which imposes a smoothness constraint by minimizing first and second derivatives of a specified emphasis e. The second function is a communication constraint R, or "error", which minimizes the sum of errors $\eta$ between the emphasis e and the targets X. This constraint models the requirement that precision in speech is necessary in order to be understood by a hearer.

The errors are weighted by the strength $S_i$ of the tag which indicates how important it is to satisfy the specifications of the tag. If the strength of a tag is weak, the physiological constraint dominates and in those cases smoothness becomes more important than accuracy. $S_i$ controls the interaction of accent tags with their neighbors by way of the smoothness requirement G. Stronger tags exert more influence on their neighbors. Tags also include parameters $\alpha$ and $\beta$, which control whether errors in the shape or average value of $e_t$ is most important. These parameters are derived from the "type" parameter. The targets, X, may be represented by an accent component riding on top of a phrase curve.

The values of G, R and $\eta$ are given by the following equations:

$$G = \sum_t \dot{e}_t^2 + (\pi\tau)^2 \ddot{e}_t^2$$

$$R = \sum_{i \in tags} S_i^2 \eta_i$$

$$\eta_i = \sum_{i \in tagi} \alpha(e_t - X_t)^2 + \beta(\bar{e} - \bar{X})^2$$

Tags are generally processed so as to minimize the sum of G and R. The above equations illustrate the minimization of the combination of effort and movement error in the processing tags defining prosody.

It will be recognized that the above equations for G and R are approximations to true muscle dynamics and to the true cost of communication errors. One skilled in the art could, given detailed knowledge of the system to be modeled, produce equations for G and R that are more accurate for a particular application. For instance, were it known that the muscle to be modeled cannot move faster than $V_{max}$, a function could be chosen for G that is very large when $\dot{e}_t^2 >> V_{max}^2$. The minimization process taught here would then result in an $e_t$ that changes suitably slowly.

Figure 17:
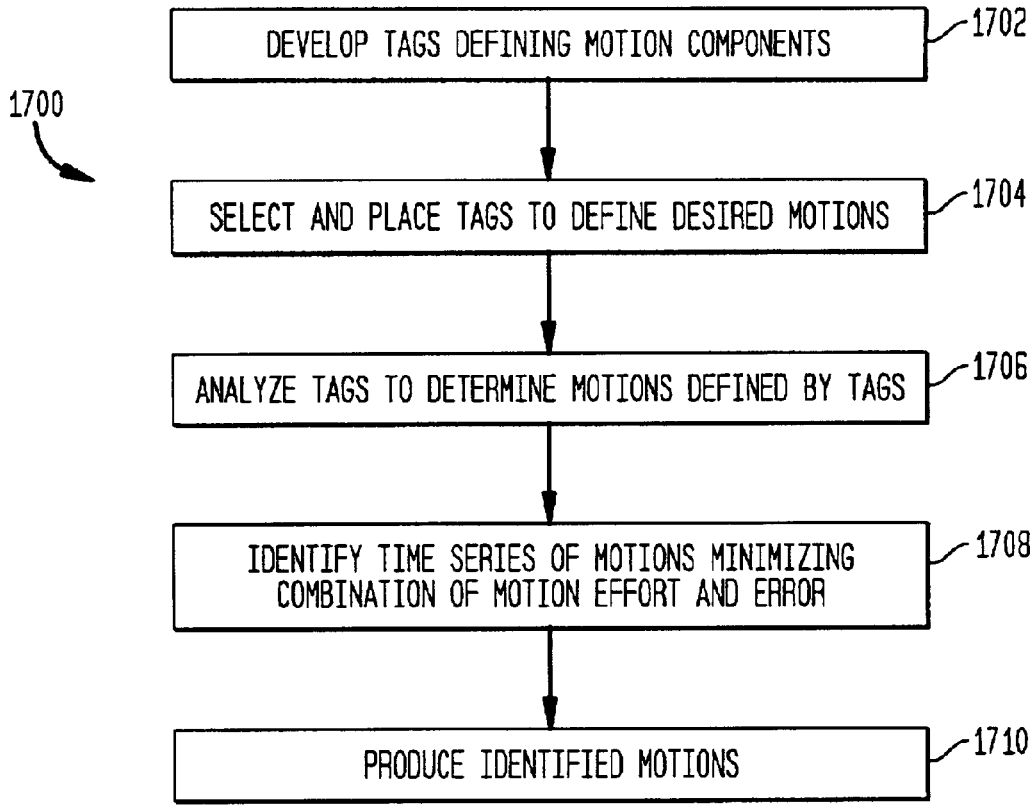
FIG. 17 illustrates a process of generating and using tags to define and generate motion according to the present invention.

FIG. 17 illustrates a process 1700 of modeling motion phenomena which are continuous and subject to constraints, such as muscle dynamics. At step 1702, a set of tags is developed to define desired motion components. At step 1704, tags are selected and placed in order to define a desired set of motions. At step 1706, the tags are analyzed to determine the motions defined by the tags. At step 1708, a time series of motions is identified which will minimize a combination of motion effort, that is, effort required to produce the motions, and motion error, that is, deviation from the motions as defined by the tags. At step 1710, the identified series of motions is produced. It will be recognized that step 1702 will be performed relatively infrequently, when a set of tags to define motions to be generated is to be produced, and step 1704–1710 will be performed more frequently, whenever the tags are to be employed to define and generate motion.

The above discussion has described techniques for generating and using tags suitable for describing and model phenomena which are continuous and subject to physiological constraints. A widely used application in which such techniques are useful is the description and modeling of prosodic characteristics of speech in text to speech generation, and a set of tags has been described suitable for modeling such characteristics. Illustrations of the effects of tags have been presented, as well as techniques for processing tags. Processes of generation, selection, placement and processing of tags have been presented, as well as a text to speech system using tags to produce speech having desired prosodic characteristics. Finally, a process of generating and using tags to define and produce a sequence of motions has been described.

While the present invention is disclosed in the context of a presently preferred embodiment, it will be recognized that a wide variety of implementations may be employed by persons of ordinary skill in the art consistent with the above discussion and the claims which follow below.

We claim:

1. A method of modeling phenomena comprising the steps of:

analyzing one or more instances of actual phenomena to identify characteristics of the instances of the actual phenomena;

creating a set of tags defining the identified characteristics of the one or more instances of the actual phenomena each tag controlling one or more aspects of one or more molded phenomena to be produced in response to the tags, the tags controlling the aspects of the modeled phenomena so as to create characteristics in the modeled phenomena similar to those exhibited by the one or more instances of the actual phenomena;

arranging selected members of the set of tags in a desired sequence to produce phenomena as defined by the sequence of tags; and processing the tags in order to produce phenomena having the characteristics defined by the tags.

2. The method of claim 1 wherein the phenomena controlled by the tags are characteristics of speech, wherein the step of arranging selected members of the tags in a desired sequence comprises placing the selected members of the set of tags into a body of text and wherein the step of processing the tags comprises processing the body of text and the tags to produce speech having characteristics defined by the tags.

3. The method of claim 2 wherein the characteristics of speech arc prosodic characteristics of speech.

4. The method of claim 3 wherein each tag imposes a constraint on the prosodic characteristics of speech affected by the tag.

5. The method of claim 4 wherein each of the tags specifies an action to be taken and includes parameters defining attributes and associated values providing information about the action to be taken.

6. The method of claim 5 wherein each of the tags may include a parameter specifying the location at which the tag takes effect.

7. The method of claim 6 wherein the set of tags includes tags which establish settings which remain unchanged until altered by a subsequent tag.

8. The method of claim 7 wherein the set of tags includes members which define the pitch behavior of speech over the course of a phrase.

9. The method of claim 8 wherein the set of tags includes tags defining accents which define the pitch behavior of local influences within a phrase.

10. The method of claim 9 wherein each of the tags may include values defining type and strength in order to define interaction of the tag with other tags.

11. The method of claim 10 wherein a tag may compromise its shape, average pitch or both depending on the value defining type.

12. The method of claim 9 wherein the step of processing the tags includes establishing a pitch curve by creating and solving equations defined by tags which specify accents.

13. The method of claim 12 wherein the body of text and the tags are processed one minor phrase at a time.

14. The method of claim 13 wherein processing of a phrase includes using values describing properties prevailing near the end of an immediately preceding phrase.

15. The method of claim 9 wherein one or more tags are placed within a proper noun comprising two or more words, each such tag producing prosody indicating to a listener that the proper noun is to be interpreted as a single entity rather than as more than one entity.

16. The method of claim 15 wherein the tag produces an increase in the pitch and speed of speech over the speech affected by the tag.

17. The method of claim 9 wherein one or more tags are placed to produce a word having prosody indicating that the word requires confirmation.

18. The method of claim 17 wherein the prosody indicating that the word requires confirmation is characterized by a relatively high and increasing pitch across the word requiring confirmation.

19. The method of claim 6 wherein the set of tags includes tags defining phrase boundaries which mark boundaries between regions at which tags have effect.

20. The method of claim 19 wherein a tag which defines a phrase boundary prevents tags following the tag which marks the boundary from influencing speech components preceding the tag which marks the boundary.

21. The method of claim 8 wherein the step of processing the tags includes establishing a phrase curve by creating and solving equations defined by tags which specifying changes in pitch and tags which specifying rates of changes in pitch.

22. The method of claim 21 wherein the body of text and the tags are processed one minor phrase at a time.

23. The method of claim 22 wherein processing of a phrase includes using values describing properties prevailing near the end of an immediately preceding phrase.

24. The method of claim 2 wherein each tag imposes a constraint on motion of an articulator used to produce speech.

25. The method of claim 1 wherein each tag imposes a constraint on modeled muscular motions used to simulate gestures or facial expression.

26. A method of processing a body of text including tags defining prosodic characteristics of speech to be produced by processing the texts comprising the steps of:

extracting the tags from the text;

creating a set of equations defining a phrase curve;

solving the set of equations to produce the phrase curve;

creating a set of equations defining a pitch curve;

solving the set of equations to produce the pitch curve;

mapping linguistic concepts represented by the phrase curve and the pitch curve to acoustical observables; and performing a nonlinear transformation to adjust the prosodic characteristics defined by tags to human perceptions and expectations.

27. A method of defining a set of tags specifying prosodic characteristics of speech of a target speaker, comprising the steps of:

selecting a body of training text;

receiving speech representing reading of the training text by the target speaker to form a training corpus, the training corpus representing actual sounds produced by the reading of the training text by the target speaker and exhibiting prosodic characteristics of actual speech of the target speaker;

analyzing the training corpus to identify prosodic characteristics of the training corpus; and creating a set of tags defining the identified prosodic characteristics of the training corpus.

28. A method of placing tags in text for text to speech processing comprising the steps of:

placing tags in a body of training text to model prosodic characteristics of a training corpus produced by reading of the training text;

analyzing the placement of the tags in the training text to develop a set of rules for placement of tags in text; and applying the rules to text for which text to speech processing is desired to place tags in the text in order to produce speech having desired prosodic characteristics.

29. A text to speech system for receiving text inputs comprising text to be processed to generate speech and tags defining prosodic characteristics of the speech to be generated, comprising:

a prosody tag generation component to analyze a training corpus to identify characteristics exhibited by one or more readings of text by one or more target speakers and to generate a set of tags defining the identified characteristics;

a text input interface for receiving the text input;

a speech modeler operative to process the text inputs to produce speech having the prosodic characteristics specified by the tags, such that the speech produced by the speech modeler is similar to that of the one or more target speakers; and a speech output interface for producing the speech output.

30. The system of claim 29 wherein the speech modeler is further operative to process a training corpus representing a reading of text by a target speaker to produce tags defining prosodic characteristics of the training corpus and use the tags to produce speech having prosodic characteristics typical of the target speaker.

* * * * *